US008311423B2

(12) United States Patent
Koizumi et al.

(10) Patent No.: US 8,311,423 B2
(45) Date of Patent: Nov. 13, 2012

(54) IMAGE FORMING APPARATUS

(75) Inventors: Eichi Koizumi, Kawasaki (JP); Shinji Kato, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/369,483

(22) Filed: Feb. 9, 2012

(65) Prior Publication Data

US 2012/0163845 A1 Jun. 28, 2012

Related U.S. Application Data

(63) Continuation of application No. 12/112,525, filed on Apr. 30, 2008, now Pat. No. 8,139,962.

(30) Foreign Application Priority Data

May 1, 2007 (JP) ..... 2007-121141
Apr. 16, 2008 (JP) ..... 2008-106335

(51) Int. Cl.
*G03G 15/08* (2006.01)

(52) U.S. Cl. ..... 399/30; 399/58; 399/258

(58) Field of Classification Search ..... 399/90, 399/56, 258
See application file for complete search history.

(56) References Cited

U.S. PATENT DOCUMENTS 5,040,023 A 8/1991 Yokoyama
6,167,211 A * 12/2000 Oogi et al. ..... 399/53
6,181,886 B1 1/2001 Hockey et al.
7,657,194 B2 2/2010 Tanaka et al.
2008/0019712 A1 1/2008 Tanaka et al.
2008/0240760 A1 10/2008 Tanaka
2010/0086320 A1 4/2010 Koizumi et al.
2010/0086322 A1 4/2010 Koizumi et al.
2010/0111547 A1 * 5/2010 Kawamoto et al. ..... 399/30
2012/0027434 A1 2/2012 Koizumi et al.

FOREIGN PATENT DOCUMENTS

JP 11-219015 8/1999
JP 3013550 12/1999
JP 2006-47965 2/2006

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus that includes a latent image carrier, a latent image forming unit, a developing unit, a toner supplier, a toner concentration detector, a prediction calculator, and a toner supply controller. The toner supplier includes a single driving source and supplies toner to a two-component developer at a predetermined supply position by driving a toner supply member with the driving source. The toner concentration detector detects a toner concentration in the developer at a predetermined detection position located upstream of the supply position. The prediction calculator predicts changes in the toner concentration in the developer over time at a prediction position located at the supply position or downstream of the supply position and upstream of a developer feed position to the developer carrier when toner is not supplied. The toner supply controller adjusts an amount of the toner supplied based on the prediction.

4 Claims, 17 Drawing Sheets

IMAGE FORMING APPARATUS

CROSS-REFERENCE TO RELATED APPLICATIONS

This application is a continuation application of U.S. application Ser. No. 12/112,525, filed Apr. 30, 2008, which claims priority from Japanese Patent Application Nos. 2007-12141, filed on May 1, 2007 and 2008-106335, filed on Apr. 16, 2008, in the Japan Patent Office, the entire contents of each of which are hereby incorporated by reference herein.

BACKGROUND OF THE INVENTION

1. Field of the Invention

The present invention generally relates to an image forming apparatus such as a copier, a printer, a facsimile machine, and a multifunction machine including at least two of these functions.

2. Discussion of the Background Art

In general, an electrophotographic image forming apparatus such as a copier, a printer, a facsimile machine, etc., includes a latent image carrier on which an electrostatic latent image is formed, and a developing unit to develop the electrostatic latent image with developer. The developed image is then transferred onto a sheet of recording medium and fixed thereon.

To develop electrostatic latent images, two-component developer including toner and magnetic carrier is widely used. While such two-component developer is circulated through the developing unit, the toner is consumed in image development, and a toner supplier supplies toner to compensate for the consumption.

In a known toner supply control method, toner consumption is predicted based on image information that is used by an exposure device to form an electrostatic latent image on the image carrier, and the toner is supplied according to the prediction.

In another known toner supply control method, a toner concentration at a predetermined position is detected with a toner concentration sensor provided on a screw that circularly transports the developer through the developing device, and the toner is supplied so as to adjust the detected toner concentration to a target concentration.

However, in these methods, the toner concentration tends to be uneven in a toner circulation direction in the developing unit, which is hereinafter referred to as toner concentration unevenness. This toner concentration unevenness is further described below with reference to FIGS. 1 through 4.

FIG. 1 is an example of a known developing unit in which such two-component developer is circulated by a first screw 180 and a second screw 110 that transport the developer along a developer circulation path in a direction shown by arrow A.

The developing unit further includes a developing roller 120 facing the second screw 110. At a portion where the second screw 110 and the developing roller 120 face each other, the developer is drawn up to a surface of the developing roller 120 and returned to the developer circulation path after passing through a development area. Further, a toner supply port 170 is located in a portion of the developer circulation path where the second screw 110 is located, and a toner concentration sensor detects changes in toner concentration in the developer at a toner concentration detection position B1.

FIGS. 2 and 3 are graphs illustrating relations between toner supply and toner concentration unevenness when the toner is supplied to the two-component developer at one time and in several batches at intervals, respectively. In each of FIGS. 2 and 3, a vertical axis shows toner concentration, a horizontal axis shows time, a thin solid line is a consumption wave, a dashed line is a supply wave, and a heavy solid line shows toner concentration unevenness.

The consumption waves show results of toner concentration detection when no toner is supplied after a given electrostatic latent image is developed with the two-component developer in which toner concentration is uniform. That is, these consumption waves show examples of toner concentration unevenness or changes in the toner concentration caused by image development.

The supply waves show results of toner concentration detection after toner is supplied to the developer in which toner concentration is uniform. It is to be noted that, in FIG. 3, chain double-dashed lines show waves of individual toner supply that is performed intermittently, and the supply wave shown by a dashed line is created by synthesizing these individual toner supply waves.

The toner concentration unevenness shown by a heavy solid line is created by synthesizing the consumption wave and the supply wave, and shows toner concentration unevenness when toner is supplied to the developer after image development.

As shown by the heavy solid lines in FIGS. 2 and 3, toner concentration becomes uneven after the toner is supplied to the developer, either at one time or in several batches at intervals, in the known methods described above. In particular, toner concentration becomes uneven when the toner is supplied regardless of the consumption wave even if the amount of the toner supplied corresponds to toner consumption, because the toner consumption wave depends on size and location of latent images on the image carrier in actual image formation.

More specifically, the toner concentration in the developer becomes uneven after development of electrostatic latent image if these electrostatic latent images are unevenly distributed on the image carrier. Relations between toner concentration unevenness and uneven distribution of latent images are described below with reference to FIG. 4.

In FIG. 4, the transport direction of the developer by the second screw 110 is shown by arrow A1, and a direction of movement of the surface of the image carrier is shown by arrow A2. Three image patterns formed on sheets of recording media are shown in an upper portion of FIG. 4, and electrostatic latent images corresponding to these image patterns are formed on the image carrier and developed with the developer in which toner concentration is uniform. Shown in a lower portion of FIG. 4 are toner concentrations detected by the toner concentration sensor when no toner is supplied after these latent images are developed.

As shown in FIG. 4, the consumption waves that show toner concentration unevenness depend on distribution of the latent images on the image carrier. It is to be noted that the consumption wave of the image pattern on the right in FIG. 4 is broader than that of the image pattern on the left because a distance between the position where the developer returns to the developer circulation path after passing through the development area and the toner concentration detection position B1 shown in FIG. 1 is longer in the case of the right image pattern than in the case of the image pattern on the left. Accordingly, the developer is agitated for a longer time period, and thus toner concentration is equalized better before the toner concentration detection in the case of the right image pattern than in the case of the left image pattern.

To resolve such toner concentration unevenness, a developing unit according to another toner supply control method has been proposed. The developing unit includes a plurality of toner suppliers each supplying toner from a different supply port. In this supply control method, density distribution of image data is analyzed using histogram analysis, and an amount of toner supplied through each toner supply port is independently controlled according to results of the analysis.

However, because such a developing unit requires a plurality of driving sources to drive the toner suppliers independently and simultaneously, its cost is relatively high and the developing unit is relatively large.

SUMMARY OF THE INVENTION

In view of the foregoing, various illustrative embodiments of the present invention disclosed herein provide an image forming apparatus and a toner supply control method that can maintain a uniform toner concentration in a two-component developer in a developing unit.

In one illustrative embodiment of the present invention, an image forming apparatus includes a latent image carrier, a latent image forming unit configured to form an electrostatic latent image on the latent image carrier, a developing unit, a toner supplier including a single driving source and a toner supply member, a toner concentration detector, a prediction calculator, and a toner supply controller. The developing unit develops the latent image with a two-component developer and includes a developer transport member configured to circulate the two-component developer along a developer circulation path, and a developer carrier configured to transport the two-component developer between a development area facing the latent image carrier and the developer circulation path. The toner supplier is connected to the developer circulation path and configured to supply toner at a predetermined supply position to the two-component developer circulating through the developer circulation path by driving a toner supply member with the driving source. The toner concentration detector is located in the developer circulation path and detects, continuously or intermittently, a toner concentration in the two-component developer at a predetermined detection position located upstream of the predetermined supply position in a developer circulation direction. The prediction calculator calculates a prediction of changes in toner concentration in the two-component developer over time at a given prediction position located at the predetermined supply position or the downstream of the predetermined supply position and upstream of a developer feed position where the two-component developer is fed to the developer carrier in the developer circulation direction when toner is not supplied, based on a detection result generated by the toner concentration detector. The toner supply controller reduces the changes in toner concentration in the developer over time at the given prediction position by controlling the driving source based on the prediction calculated by the prediction calculator to adjust an amount of the toner supplied to the two-component developer at the predetermined supply position.

In another illustrative embodiment, an image forming apparatus includes a latent image carrier, an image information acquisition unit configured to acquire image information, a latent image forming unit configured to form an electrostatic latent image on the latent image carrier according to the image information, a developing unit configured to develop the latent image with a two-component developer, a toner supplier including a single driving source and a toner supply member, a prediction calculator, and a toner supply controller. The developing unit includes a developer transport member that circulates the two-component developer along a developer circulation path, and a developer carrier that transports the two-component developer between a development area facing the latent image carrier and the developer circulation path. The toner supplier is connected to the developer circulation path and supplies toner at a predetermined supply position to the two-component developer circulating through the developer circulation path by driving the toner supply member with the driving source. The prediction calculator calculates, based on the image information, as a prediction, one of changes in a toner concentration over time in the two-component developer passing a given prediction position located at the predetermined supply position or downstream of the predetermined supply position and upstream of a developer feed position where the two-component developer is fed to the developer carrier in the developer circulation direction, caused by developing the latent image according to the image information, when toner is not supplied and a wave form showing a phase opposite that of the changes in the toner concentration over time caused by developing the latent image according to the image information. The toner supply controller reduces the changes in toner concentration over time in the developer at the given prediction position by controlling the driving source based on the prediction calculated by the prediction calculator to adjust an amount of the toner supplied to the two-component developer at the predetermined supply position.

Yet in another illustrative embodiment, a toner supply control method used in the image forming apparatus described above includes calculating, as a prediction, one of changes in the toner concentration over time in the two-component developer at a given prediction position located at the predetermined supply position or downstream of the predetermined supply position and upstream of a developer feed position where the two-component developer is fed to the developer carrier in the developer circulation direction when toner is not supplied and a wave form showing a phase opposite that of the changes in the toner concentration over time, and adjusting an amount of the toner supplied to the two-component developer at the predetermined supply position by controlling the driving source based on the prediction to reduce the changes in toner concentration over time in the developer at the given prediction position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
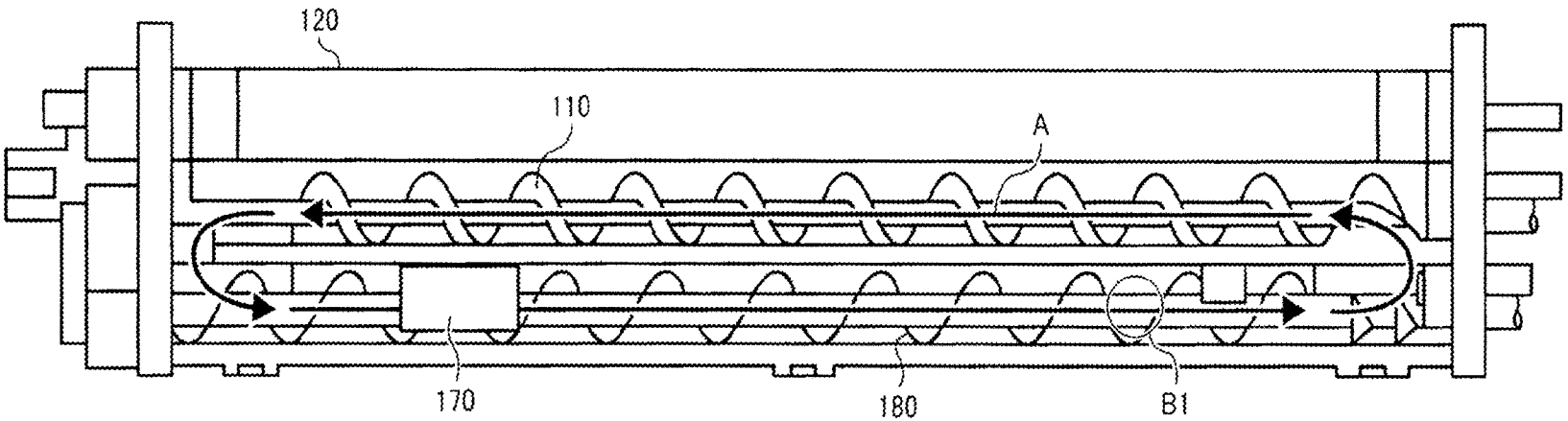
FIG. 1 illustrates an example of a related art developing unit that circulates a two-component developer along a developer circulation path.
Figure 2:
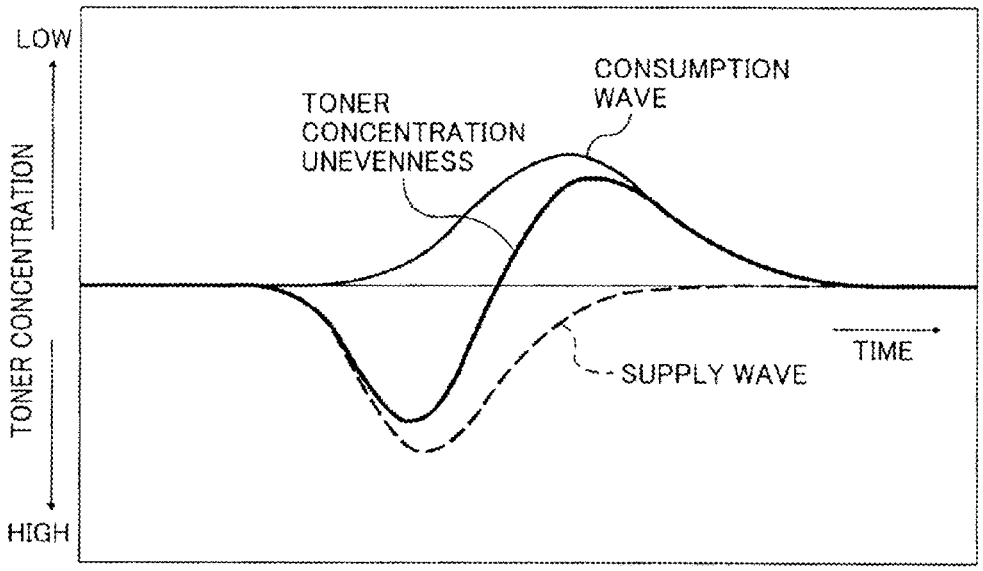
FIG. 2 is a graph illustrating relations between toner supply and toner concentration unevenness when toner is supplied to the two-component developer at one time through a known method.
Figure 3:
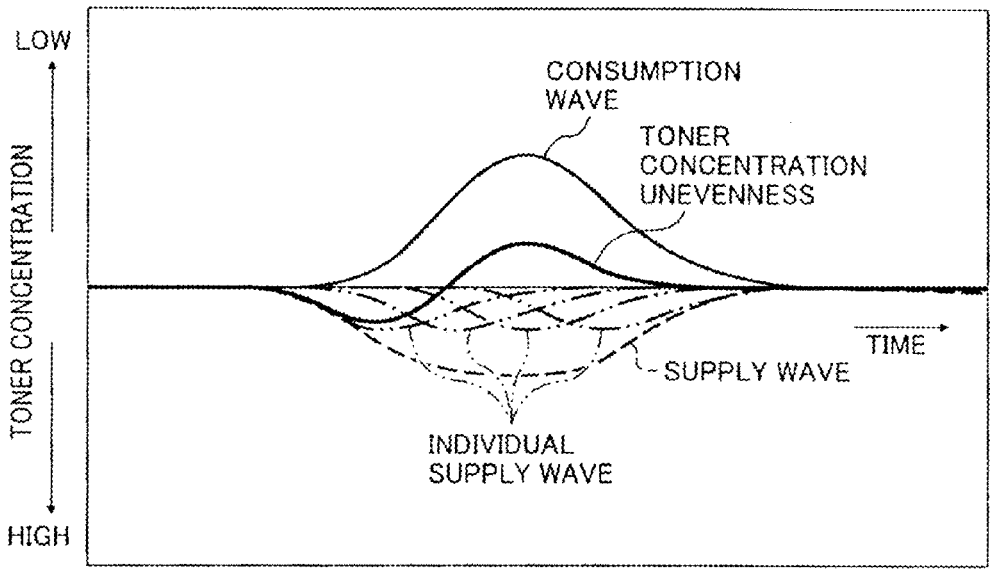
FIG. 3 is a graph illustrating relations between toner supply and toner concentration unevenness when toner is supplied to the two-component developer in several batches at intervals through a known method.
Figure 4:
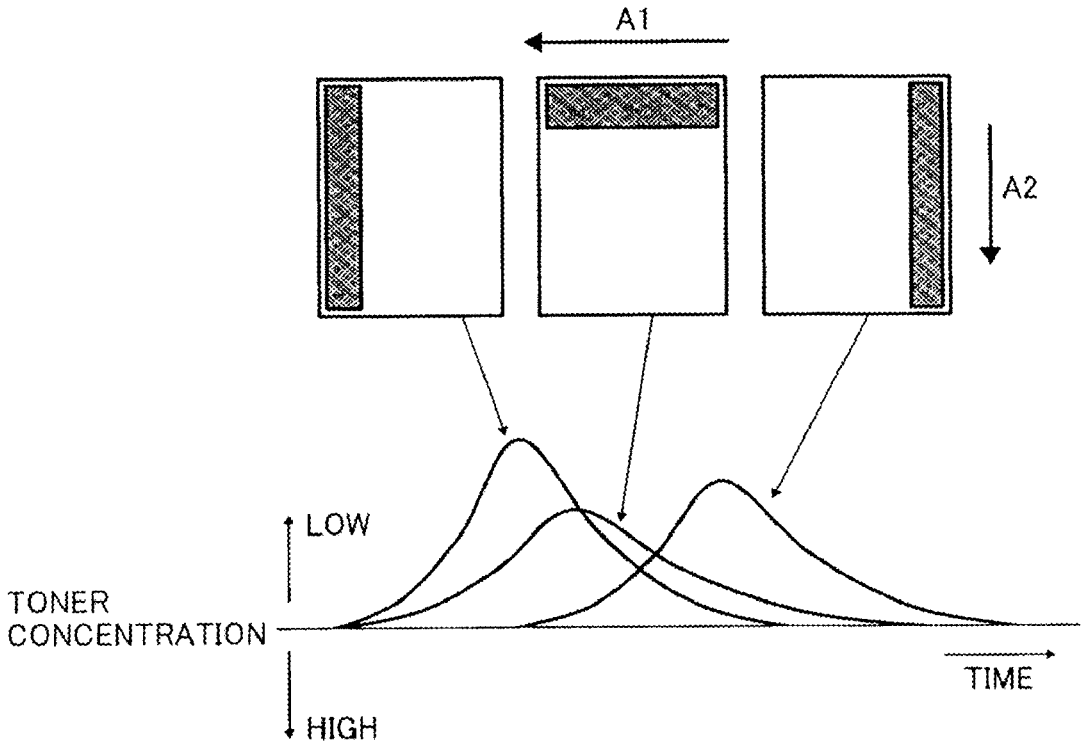
FIG. 4 illustrates relations between the toner concentration unevenness and locations of latent images formed on a photoreceptor drum.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 5:
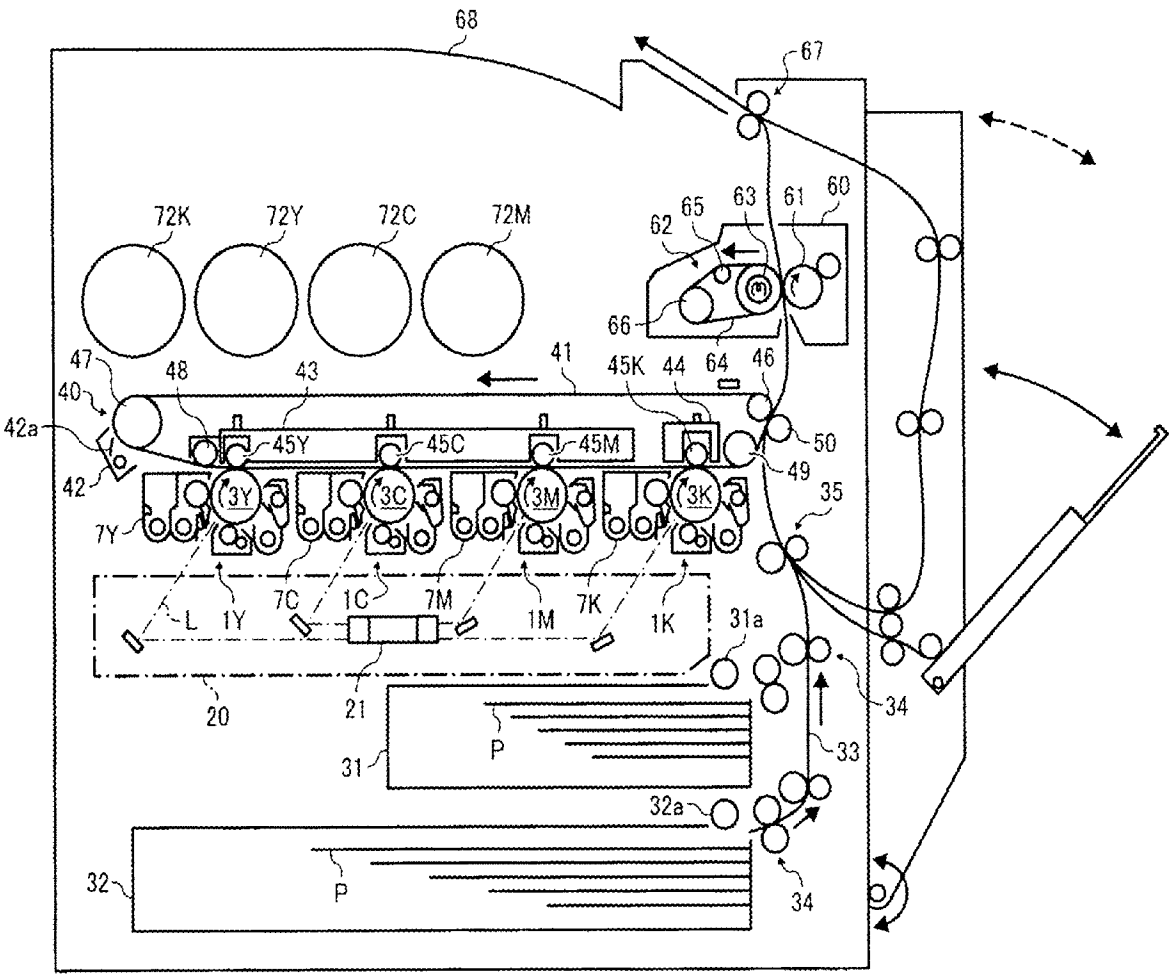
FIG. 5 is a schematic illustration of an image forming apparatus according to an illustrative embodiment of the present invention.

Referring now to the drawings, wherein like reference numerals designate identical or corresponding parts throughout the several views thereof, and particularly to FIG. 5, an electronographic image forming apparatus according to an illustrative embodiment of the present invention is described.

FIG. 5 is a schematic illustration of the image forming apparatus that is an electronographic printer, for example, and uses a two-component developer including toner and carrier.

The image forming apparatus includes four process units 1Y, 1M, 1C, and 1K for forming yellow, magenta, cyan, and black images, respectively. The reference characters Y, M, C, and K show yellow, magenta, cyan, and black, respectively. The process units 1Y, 1M, 1C, and 1K have a similar configuration except for the color of toner used to form images and include one of photoreceptor drums 3Y, 3M, 3C, and 3K, and one of developing unit 7Y, 7C, 7M, and 7K, respectively.

In FIG. 5, beneath the process units 1Y, 1M, 1C, and 1K, an optical writing unit 20 is provided. The optical writing unit 20 includes a light source, not shown, and a polygon mirror 21. The light source, not shown, emits laser lights L based on image information, and the polygon mirror 21 deflects the laser lights L, which is directed onto the respective photoreceptor drums 3Y, 3M, 3C, and 3K via optical lenses, mirrors, etc, and thus electrostatic latent images for yellow, magenta, cyan, and black images are formed thereon, respectively. Alternatively, an optical writing unit using an LED (light-emitting diode) array may be used instead of the optical writing unit 20.

The developing units 7Y, 7M, 7C, and 7K develop the respective electrostatic latent images on the photoreceptor drums 3Y, 3M, 3C, and 3K with one of yellow, cyan, magenta, and black toner into toner images.

The image forming apparatus further includes a first sheet cassette 31 and a second sheet cassette 32 that are located vertically in line, beneath the optical writing unit 20, and an intermediate transfer unit 41 located above the image forming units 1Y, 1M, 1C, and 1K. The first sheet cassette 31 and the second sheet cassette 32 contain a batch of sheets P that are recording media, and include a first feed roller 31*a* and a second feed roller 32*a* that are in contact with a top sheet of the sheets P contained therein, respectively. The intermediate transfer unit 40 includes an intermediate transfer belt 41 that is looped around rollers and endlessly moves counterclockwise in FIG. 5. The yellow, magenta, cyan, and black images formed by the image forming units 1Y, 1M, 1C, and 1K are transferred therefrom and superimposed one on another on the intermediate transfer belt 41.

When a driving member, not shown, rotary drives the first feed roller 31*a* counterclockwise in FIG. 5, the sheet P on the top in the first sheet cassette 31 is fed to a sheet feed path 33 that extends vertically in a right portion of the image forming apparatus. Similarly, when a driving member, not shown, rotary drives the second feed roller 32*a* counterclockwise in FIG. 5, the sheet P on the top in the second sheet cassette 32 is fed to the sheet feed path 33.

Along the sheet feed path 33, multiple pairs of rollers 34 are provided, and a pair of registration rollers 35 is provided at an end portion of the sheet feed path 33. The rollers 34 sandwich the sheet P therebetween and transport the sheet P upward to the registration rollers 35. The registration rollers 35 stop rotation immediately after sandwiching the sheet P therebetween and then forward the sheet P to a secondary transfer nip in a timely manner so that the sheet P overlaps the superimposed image on the intermediate transfer belt 41.

The intermediate transfer unit 40 further includes a belt cleaning unit 42, a first bracket 43, a second bracket 44, four primary transfer rollers 45Y, 45C, 45M, and 45K, a backup roller 46, a driving roller 47, an auxiliary roller 48, and a tension roller 49.

The primary transfer rollers 45Y, 45C, 45M, and 45K sandwich the intermediate transfer belt 41 with the photoreceptor drums 3Y, 3C, 3M, and 3K, respectively, and thus primary transfer nips for yellow, cyan, magenta, and black are formed therebetween. Further, the primary transfer rollers 45Y, 45C, 45M, and 45K apply transfer biases having a polarity opposite a polarity of the toner to an inner surface of the intermediate transfer belt 41. In the present embodiment, the transfer biases have a positive polarity. While the intermediate transfer belt passes the respective primary transfer nips, the respective color toner images are transferred from the photoreceptor drums 3Y, 3C, 3M, and 3K and superimposed one on another on an outer surface of the intermediate transfer belt 41 in a primary transfer process. Thus, the superimposed toner image is formed on the intermediate transfer belt 41.

The backup roller 46 sandwiches the intermediate transfer belt 41 with a secondary transfer roller 50 that is provided outside of the intermediate transfer belt 41, and thus the secondary transfer nip is formed therebetween. The superimposed toner image on the intermediate transfer belt 41 is secondarily transferred onto the sheet P with effects of a secondary transfer electrical field formed between the secondary transfer roller 50 and the backup roller 46, and a nip pressure. The superimposed toner image becomes a full color image on the sheet P with effects of the color of the sheet P, because typically this color is white.

The belt cleaning unit 42 includes a cleaning blade 42*a* and removes any toner that is not transferred onto the sheet P, but remains on the intermediate transfer belt 41 after passing the secondary transfer nip. It is to be noted that the cleaning blade 42*a* contacts the outer surface of the intermediate transfer belt 41 so as to scrape off the toner remaining thereon.

The first bracket 43 swings on a rotation axis of the auxiliary roller 48 for a given angle with on/off switching operations of a solenoid, not shown. In the present embodiment, in monochrome image forming, the first bracket 43 is slightly swung counterclockwise in FIG. 5 by switching of the solenoid. This movement causes the primary transfer rollers 45Y, 45C, 45M, and 45K to revolute counterclockwise around the rotation axis of the auxiliary roller, which moves the intermediate transfer belt 41 away from the photoreceptor drums 3Y, 3C, and 3M. Then, only the process unit 1K for black is driven to form a monochrome image. Thus, the process units 1Y, 1C, and 1M are not unnecessarily driven in monochrome image forming, and wear thereof can be reduced.

The image forming apparatus further includes a fixer 60 located above the secondary transfer nip in FIG. 5, a pair of discharge roller 67, a stack part 68, and toner cartridges 72Y, 72C, 72M, and 72K.

The fixer 60 includes a pressure heating roller 61 provided with a heat source such as a halogen lamp, and a fixing belt unit 62. The fixing belt unit 62 includes a heating roller 63 provided with a heat source such as a halogen lamp, a fixing belt 64, a tension roller 65, a driving roller 66, and a temperature sensor, not shown. The fixing belt 64 is looped around the heating roller 63, the tension roller 65, and the driving roller 66, and moves endlessly counterclockwise in FIG. 5. While the fixing belt 64 moves counterclockwise, the heating roller 63 heats the fixing belt 64 from its inside. The pressure heating roller 61 rotates clockwise and presses against an outer surface of a portion of the fixing belt 64 that is looped around the heating roller 63, and thus a fixing nip is formed between the pressure heating roller 61 and the fixing belt 64.

The temperature sensor, not shown, is provided outside of the fixing belt 64 to face the outer surface of the fixing belt 64 with a given space, and detects a surface temperature of the fixing belt 64 immediately before the fixing belt enters the fixing nip. A result of this detection is sent to a fixing power source circuit, not shown, that turns on and off power to the heat sources included in the pressure heating roller 61 and the heating roller 63 based on the detection result, and the surface temperature of the fixing belt 64 is kept at about 140° C.

After passing through the secondary transfer nip, the sheet P leaves the intermediate transfer belt 41 and is sent into the fixer 60. While transporting the sheet P sandwiched between the heating roller 61 and the fixing belt 64 through the fixing nip upward in FIG. 5, the fixer 60 fixes the toner image thereon with heat and pressure.

After the toner image is fixed thereon, the sheet P is discharged by the discharge rollers 67 outside the image forming apparatus, and stacked on the stack part 68 provided on an upper surface of a housing of a main body of the image forming apparatus.

The toner cartridges 72Y, 72C, 72M, and 72K are located above the transfer unit 40 and contain yellow, cyan, magenta, and black toners, respectively. The yellow, cyan, magenta, and black toners are supplied to the developing units 7Y, 7C, 7M, and 7K in the process cartridges 1Y, 1C, 1M, and 1K, respectively. The toner cartridges 72Y, 72C, 72M, and 72K are installable and removable from the image forming apparatus independently from the process cartridges 1Y, 1C, 1M, and 1K.

Figure 6:
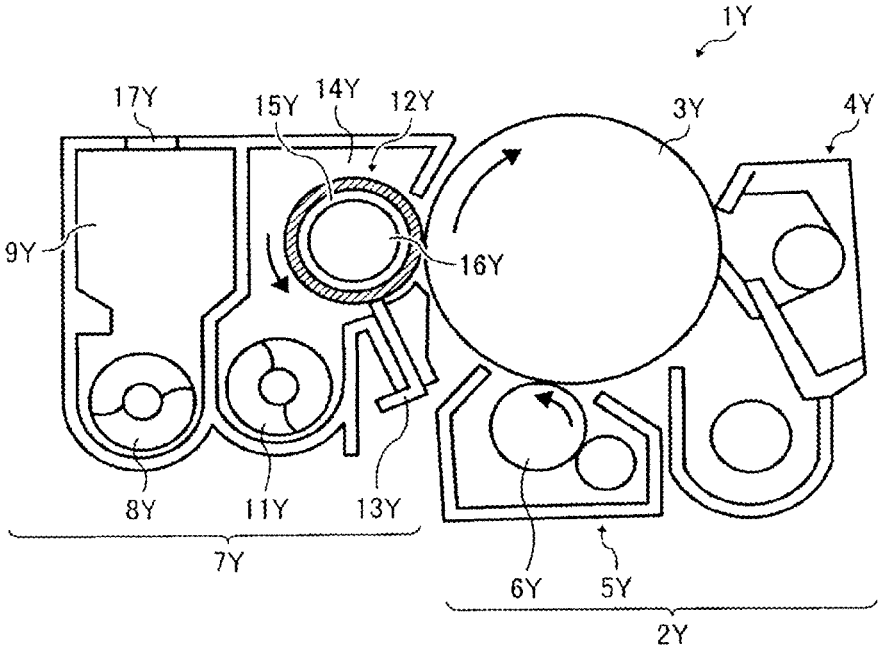
FIG. 6 is a schematic illustration of a process unit for forming yellow toner images included in the image forming apparatus shown in FIG. 5.
Figure 7:
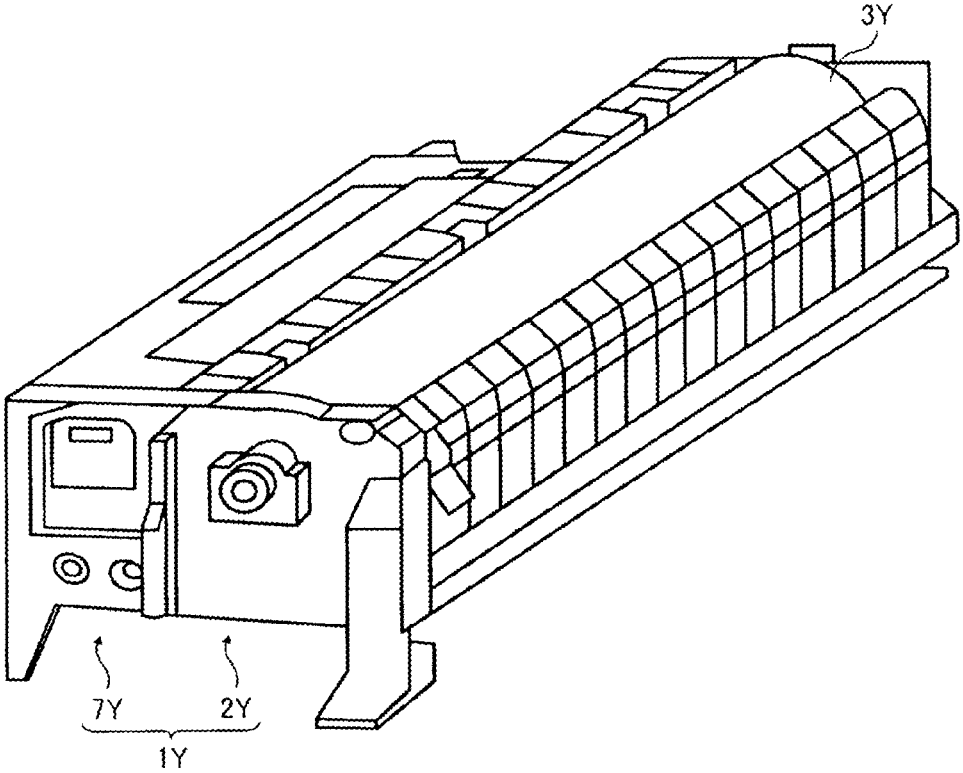
FIG. 7 is a perspective diagram illustrating exterior of the process unit shown in FIG. 6.

FIG. 6 is a schematic illustration of the process unit 1Y for forming yellow toner images, and FIG. 7 is a perspective illustration of the process unit 1Y.

With reference to FIGS. 6 and 7, the process unit 1Y is described below. Because the configurations of the process units 1C, 1M, and 1K are similar to that of the process unit 1Y, descriptions thereof are omitted.

The process unit 1Y includes a photoreceptor unit 2Y including the photoreceptor drum 3Y, and the developing unit 7Y. These photoreceptor unit 2Y and the developing unit 7Y are configured to integrally installable to and removable from the image forming apparatus as illustrated in FIG. 7. When the developing unit 7Y and the photoreceptor unit 2Y are removed from the image forming apparatus, the developing unit 7Y is attachable to and removable from the photoreceptor unit 2Y.

The photoreceptor unit 2Y further includes a drum cleaner 4Y, a charger 5Y including a charging roller 6Y, and a discharger, not shown, that is configured to remove charges from the photoreceptor drum 3Y after an yellow image is transferred therefrom onto the intermediate transfer belt 41 shown in FIG. 5.

The charging roller 6Y uniformly charges the surface of the photoreceptor drum 3Y that is rotationally driven clockwise in FIG. 6 by a driving member, not shown. More specifically, a charging bias from a power source, not shown, is applied to the charging roller 6Y that rotates counterclockwise in FIG. 6, and the photoreceptor drum 3Y is charged when the charging roller 6Y approaches or contacts the photoreceptor drum 3Y.

It is to be noted that, alternatively, another type of charging member such as a charging brush can be used instead of the charging roller 6Y. Alternatively, the photoreceptor drum 3Y can be charged through a charger method using a scorotron charger, for example.

After the surface of the photoreceptor drum 3Y is thus uniformly charged, the optical writing unit 20 directs a laser light to form an electrostatic latent image for an yellow image thereon, as described above.

Figure 8:
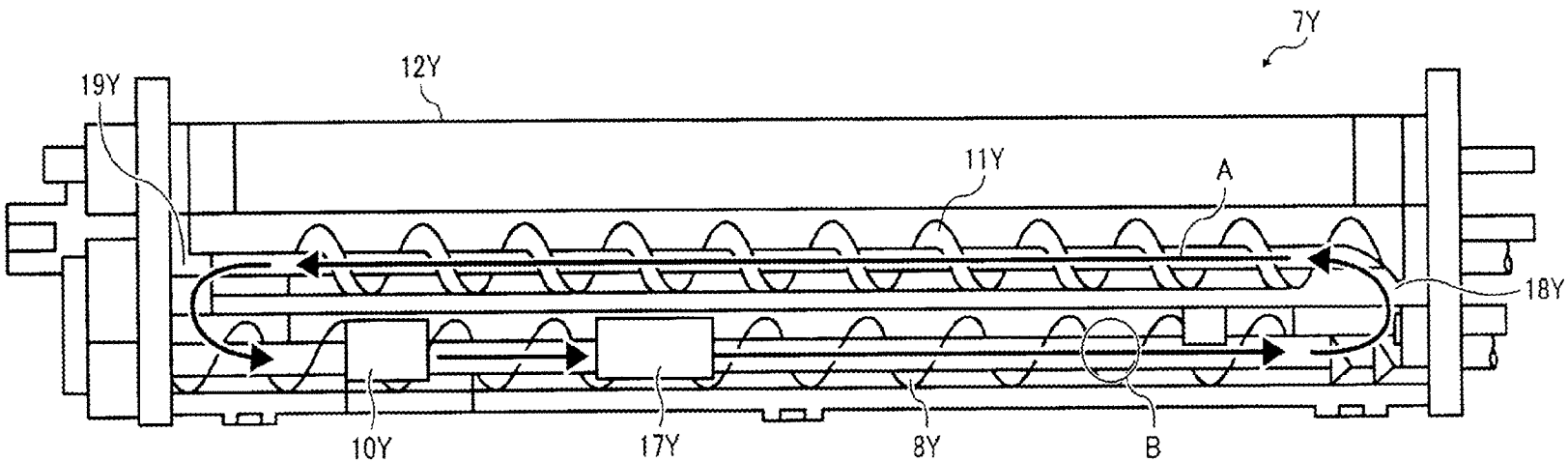
FIG. 8 illustrates a configuration around a developer circulation path of a developing unit included in the process unit shown in FIG. 6.

FIG. 8 illustrates a configuration around a developer circulation path of the developing unit 7Y along which the two-component developer is circulated. Referring to FIGS. 6 and 8, the developing unit 7Y is described below.

As illustrated in FIGS. 6 and 8, the developing unit 7Y includes a first portion 9Y provided with a first screw 8Y and a toner supply port 17Y, and a second portion 14Y provided with a second screw 11Y. The first screw 8Y and the second screw 11Y are developer transport members. The second portion 14Y further includes a developing roller 12Y as a developer carrier, and a doctor blade 13Y as a developer regulator.

The first portion 9Y and the second portion 14Y contain yellow developer that is the two-component developer including magnetic carrier and the yellow toner that is negatively charged. The two-component developer is hereinafter simply referred to as the developer. The first screw 8Y is rotationally driven by a driving member, not shown, and transports the developer in the first portion 9Y in a direction from a back side to a front side of the sheet on which FIG. 6 is drawn, which is a developer circulation direction shown by arrow A in FIG. 8.

As illustrated in FIG. 8, the developing unit 7Y further includes a toner concentration sensor 10Y provided on a first screw 8Y, and communication ports 18Y and 19Y. The toner concentration sensor 10Y is a magnetic permeability sensor, for example, and detects, either continuously or at intervals, a toner concentration in the developer that is passing a predetermined or given detection position located upstream of a supply position that faces the toner supply port 17Y in the developer circulation direction shown by arrow A. Reference character B indicates another detection position, which is described below.

When the first screw 8Y transports the developer to a downstream end portion of the first portion 9Y, the developer moves to the second portion 14Y through the communication port 18Y.

The second screw 11Y in the second portion 14Y is rotationally driven by a driving member, not shown, and transports the developer in a direction from the front side to the back side of the sheet on which FIG. 6 is drawn, which is the developer circulation direction shown by arrow A in FIG. 8. The developing roller 12Y is located above the second screw 11Y in FIG. 6 in parallel thereto. This developing roller 12Y includes a nonmagnetic developing sleeve 15Y that rotates counterclockwise in FIG. 6 and a magnet roller 16Y fixed inside the developing sleeve 15Y. Due to magnetism of the magnet roller 16Y, the developer transported by the second screw 11Y is partly brought up to a surface of the developing sleeve 15Y. This portion where the developer is fed to the developing roller 12Y is hereinafter referred to as a toner feed portion.

After the doctor blade 13Y that faces the surface of the developing sleeve 15Y with a predetermined or given space regulates a thickness of a developer layer formed on the developing sleeve 15Y, the developer on the developing sleeve 15Y is transported to a development area in which the developing sleeve 15Y faces the photoreceptor drum 3Y. In the development area, the toner adheres to the electrostatic latent image for yellow, developing the electrostatic latent image into a yellow toner image. After the yellow toner is thus consumed in the development, the developer is returned to the second portion 14Y where the second screw 11Y is located as the developing sleeve 15Y rotates. The developer is then transported by the second screw 11Y to a downstream end portion of the second portion 14Y and further transported to the first portion 9Y through the communication port 19Y. Thus, the developer is circulated through the developing unit 7Y.

The yellow toner image on the photoreceptor drum 3Y is transferred onto the intermediate transfer belt 41 intermediately as described above, and then the drum cleaner 4Y removes any toner remaining on the surface of the photoreceptor drum 3Y. Further, electrical charge is removed from the surface of the photoreceptor drum 3Y, and thus the surface of the photoreceptor drum 3Y is initialized and prepared for subsequent image formation.

Similarly, cyan, magenta, and black toner images are formed on the photoreceptors 3C, 3M, and 3K in the process units 1C, 1M, and 1K, respectively, and the toner images are intermediately transferred onto the intermediate transfer belt 41. As described above, the yellow, cyan, magenta, and black toner images are superimposed one on another on the intermediate transfer belt 41 shown in FIG. 5, and then secondarily transferred onto the sheet P.

Figure 9:
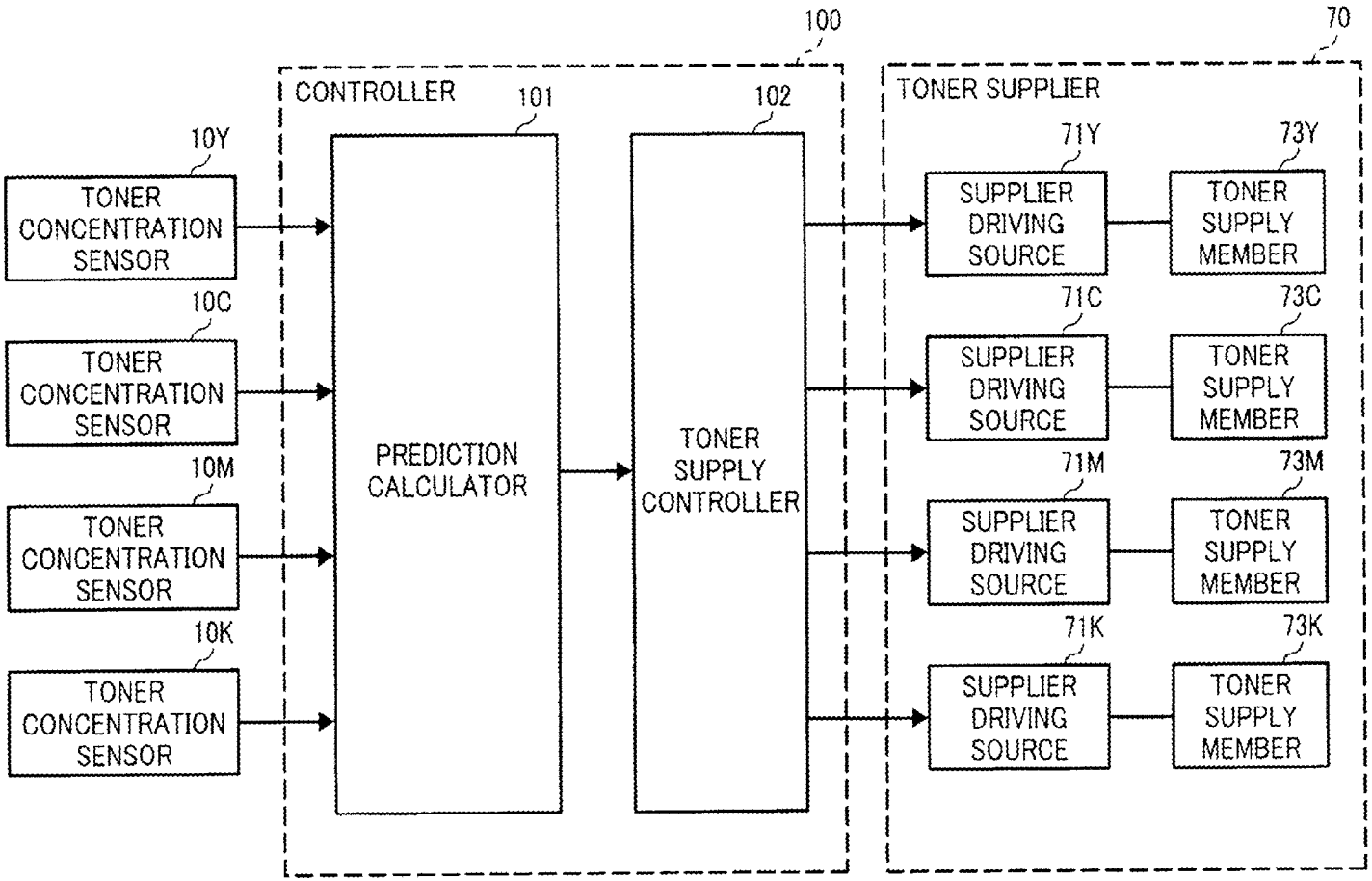
FIG. 9 is a functional block diagram of toner supply control according to the illustrative embodiment of the present invention.

With reference to FIG. 9, a functional block of toner supply control according to the present embodiment is described below.

The image forming apparatus shown in FIG. 5 further includes a controller 100 including a prediction calculator 101 that receives signals from the toner concentration detector 10Y, a toner supply controller 102, and a toner supplier 70. The toner supplier 70 includes toner supply members 73Y, 73C, 73M, and 73K for supplying the yellow, cyan, magenta, and black toners, respectively, and driving sources 71Y, 71C, 71M, and 71K for driving the toner supply members 73Y, 73C, 73M, and 73K.

The controller 100 includes a CPU (central processing unit) as a computing unit, a RAM (random access memory) as a storage unit, and a ROM (read only memory), performs various types of computation, and executes control programs.

The toner concentration sensor 10Y shown in FIG. 8 converts results of the toner concentration detection into electrical signals and transmits the electrical signals to the controller 100. Similarly to the developing unit 7Y shown in FIG. 6, the developing units 7C, 7M, and 7K includes toner concentration sensors 10C, 10M, and 10K. The RAM of the controller 100 stores a target value of each output voltage from the toner concentration sensors 10Y, 10C, 10M, and 10K, which is hereinafter referred to as target output value Vtref.

More specifically, in the case of the yellow toner, the controller 100 compares the output voltage from the toner concentration sensor 10Y with the target output value Vtref for the yellow toner, and controls the supplier driving source 71Y so that the toner supply member 73Y supplies an amount of yellow toner corresponding to a result of the comparison to the developing unit 7Y through the toner supply port 17Y.

With this control, after the yellow toner in the yellow developer is consumed and the yellow toner concentration thereof decreases, the toner supply member 73Y supplies the yellow toner to the first portion 9Y of the developing unit 7Y shown in FIG. 6 so as to compensate for the consumption, and thus the toner concentration in the yellow developer can be kept within a target concentration range. Cyan, magenta, and black toner supply in the developing units 7C, 7M, and 7K are controlled in a manner similar to the yellow toner supply control, and thus descriptions thereof are omitted.

It is to be noted that the toner supply control according to the present embodiment is performed to eliminate toner concentration unevenness.

The toner supply control according to the present embodiment is described in further detail below, with reference to FIGS. 6, 8, and 9.

As described above, in the toner supply control, the amount of the yellow toner required to keep the toner concentration in the yellow developer within a target concentration range is supplied through the toner supply port 17Y.

Further, in the present embodiment, this toner supply amount is adjusted to eliminate or reduce changes in the toner concentration in the developer over time in a period during which the developer moves from the supply position facing the toner supply port 17Y to the toner feed portion of the second portion 14Y where the developer is fed to the developing roller 12Y.

More specifically, the toner is supplied so as to eliminate or reduce changes in the toner concentration in the developer that is passing the detection position B, shown in FIG. 8, that is a given position located in an area extending from the supply position to an upstream end portion of the second portion 14Y in the toner circulation direction shown by arrow A in the present embodiment.

To adjust the toner supply amount, the toner supply controller 102 shown in FIG. 9 controls timing and a speed with which the supplier driving source 71Y is driven, and a time period during which the supplier driving source 71Y is driven to drive the toner supply member 73Y.

It is to be noted that the toner supply member 73Y can be any of various types of known toner supply members that can adjust toner supply to the developer through the toner supply port 17Y with driving force of the supplier driving source 71Y.

The toner supply controller 102 controls the supplier driving source 71Y based on a prediction generated by the prediction calculator 101 that serves as a toner concentration change calculator.

The prediction calculator 101 calculates a prediction of changes in the toner concentration in the developer at the detection position B serving as a prediction position by using computation programs, computation tables such as lookup tables (LUTs), etc., based on detection results generated by the toner concentration sensor 10Y. The toner supply controller 102 determines a combination of unit supply patterns, which is described below, based on the prediction generated by the prediction calculator 101 and controls the supplier driving source 71Y according that combination of unit supply patterns, thus preventing or reducing toner concentration unevenness.

It is to be noted that the prediction position can be set to the toner supply position. The unit supply patterns are preliminarily obtained through experiment. One example of a procedure to create the unit supply patterns is described below.

In addition to the toner concentration sensor 10Y, another concentration sensor for the experiment (experimental toner concentration sensor) is provided in the developing unit 7Y to detect a toner concentration in the developer that is passing the detection position B shown in FIG. 8. This experimental toner concentration sensor is identical or similar to the toner concentration sensor 10Y.

Firstly, basic patterns of toner supply operation performed by the toner supplier 70 (basic supply patterns) are measured. The toner supply operation means a driving operation of the supplier driving source 71Y, and an amount of toner supplied by a single driving operation of the supplier driving source 71Y is hereinafter referred to as a unit supply amount.

To measure the basic supply patterns, the toner is supplied to the yellow developer whose toner concentration is uniform through different supply patterns, and changes in the toner concentration over time at the detection position B are measured for each supply pattern. The unit supply amounts differ in these different supply patterns.

Figure 10:
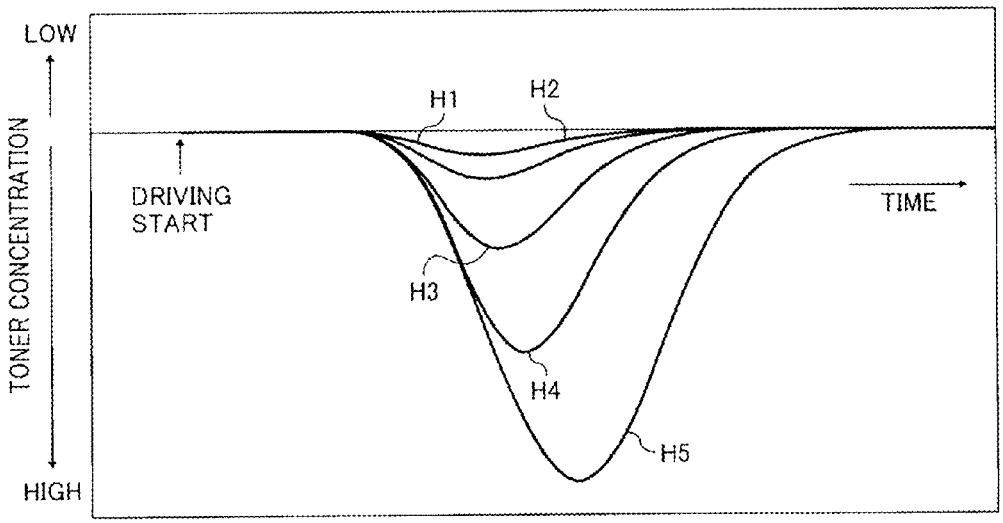
FIG. 10 is a graph illustrating basic supply waves induced by a toner supplier included in the image forming apparatus shown in FIG. 5.

FIG. 10 is a graph illustrating the basic supply patterns performed by the toner supplier 70. In an example shown in FIG. 10, five different supply patterns are measured. Reference characters H1, H2, H3, H4, and H5 indicate wave forms (basic supply waves) that show changes in the toner concentration over time when the toner is supplied through each of those different supply patterns, respectively.

It is to be noted that the unit supply amount in the basic supply waves H1, H2, H3, H4, and H5 increases in order and can be changed by changing a driving period and driving speed of the supplier driving source 71Y.

Subsequently to the measurement of the basic supply waves, consumption waves corresponding to unit image area at the detection position of the toner concentration sensor 10Y and the detection position B shown in FIG. 8 are measured.

Figure 11:
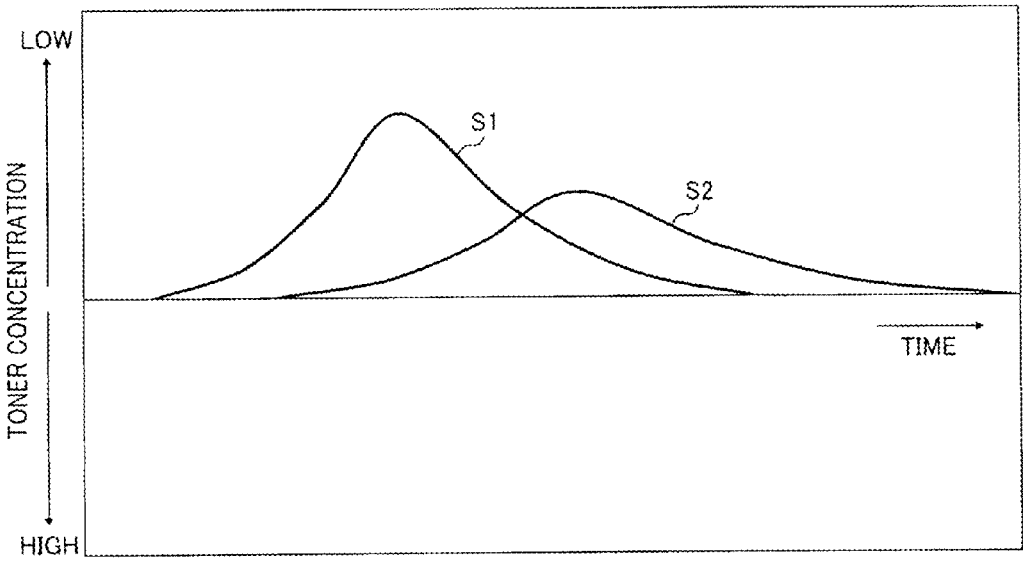
FIG. 11 is a graph illustrating unit consumption waves at the position detected by a toner concentration sensor included in the image forming apparatus shown in FIG. 5 and at a given detection position located downstream of a toner supply position.

FIG. 11 is a graph that compares a unit consumption wave S1 at the detection position of the toner concentration sensor 10Y with a unit consumption wave S2 at the detection position B. The unit consumption waves S1 and S2 show changes in the toner concentration detected by the toner concentration sensor 10Y and the experimental toner concentration sensor, respectively, when the toner is not supplied after an identical unit image having a minimum unit area used to determine the unit consumption wave is formed on the sheet P using yellow developer without toner concentration unevenness.

It is to be noted that the minimum unit area used to measure the unit consumption wave is preferably a smallest settable unit area, which depends on resolution capability of the sensor, effects of noise, and minimum amount of the toner supplied by the supplier 70, although an ideal unit area is one dot area of image information.

In the graph shown in FIG. 11, when the unit consumption waves S1 and S2 are compared with each other, their half bandwidths and minimum toner concentrations are different from each other due to locational difference between these two detection positions. More specifically, because the developer whose yellow toner is consumed to develop the unit image is agitated by the first screw 8Y while being transported to the detection position of the toner concentration sensor 10Y and further to the detection position B, the developer that is passing the detection position B is better agitated than the developer that is passing the detection position of the toner concentration position 10Y.

It is to be noted that, to measure such a unit consumption wave, the surface of the photoreceptor drum 3Y may be divided into plural areas and a unit consumption wave is measured for each area thereof.

Then, a unit supply wave to correct the toner concentration unevenness shown by the unit consumption wave S2 is determined.

Figure 12:
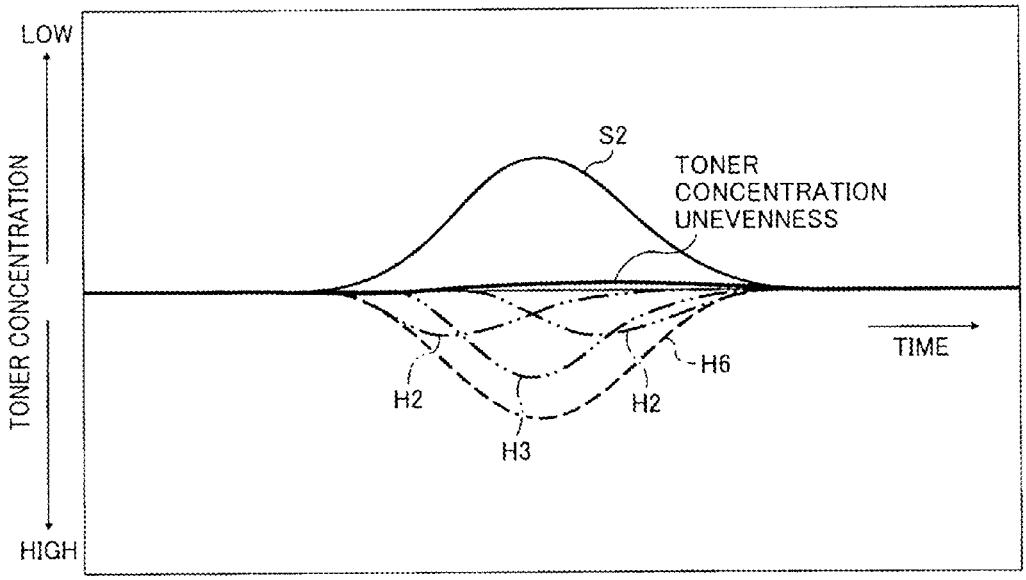
FIG. 12 is a graph illustrating the unit consumption wave and a unit supply wave that corrects toner concentration unevenness shown by the unit consumption wave.

FIG. 12 is a graph illustrating the unit consumption wave S2 measured at the detection position B and a unit supply wave H6. This unit supply wave H6 is created by combining the basic supply waves H1, H2, H3, H4, and H5 so as to compensate for the unit consumption wave S2.

The unit consumption wave S2 shows changes in the toner concentration in the developer over time that is passing the detection position B after the image corresponding to the minimum unit area for toner concentration detection is developed. By contrast, the basic supply waves H1, H2, H3, H4, and H5 respectively show changes in the toner concentration in the developer that is passing the detection position B after different unit amounts of toner are supplied by a single driving operation of the supplier driving source 71Y.

Therefore, the toner concentration in the yellow developer can be kept uniform at least downstream of the detection position B (prediction position) by supplying the toner according to the unit supply wave 116 that is identical or similar to a wave form showing a phase opposite that of the unit consumption wave S2. That is, the toner concentration can be equalized before the developer returns to the second portion 14Y to be used again in development after the developer develops one unit image.

When the unit supply wave H6 is determined as described above, a toner supply operation corresponding to the combination of the basic supply waves H1, 2H, 3H, 4H, and 5H is determined as the unit supply pattern. This unit supply pattern corresponding to the unit supply wave H6 is stored in the RAM.

In the graph shown in FIG. 12, the wave form identical or similar to the wave form showing a phase opposite that of the unit consumption wave S2 is made by supplying the toner according to the basic supply waves H2, H3, and H2 in order. That is, this toner supply operation is the unit supply pattern according to the present embodiment.

The toner supply control according to the present embodiment is described in further details below.

Figure 13:
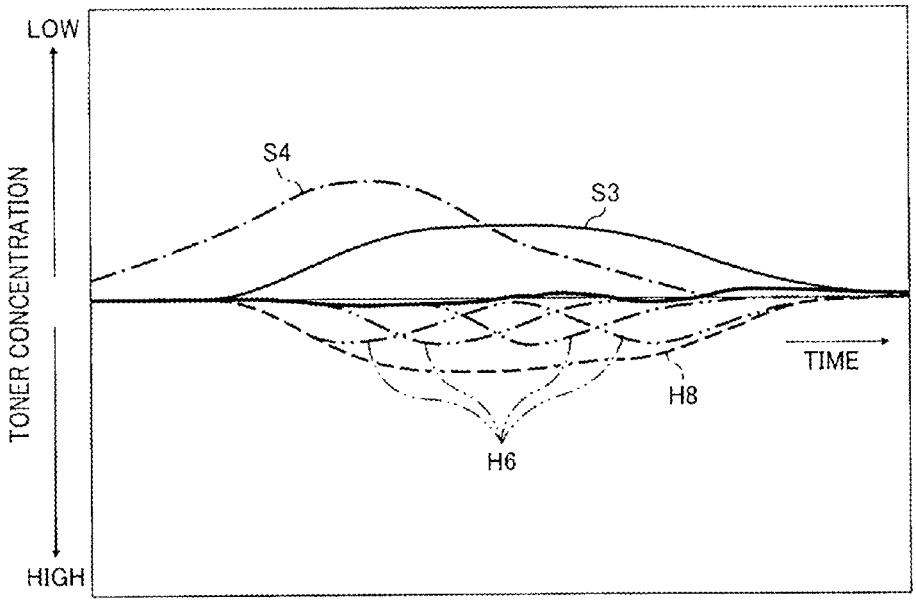
FIG. 13 is a graph illustrating a consumption wave corresponding a given image and a supply wave that corrects toner concentration unevenness shown by the consumption wave.

FIG. 13 is a graph illustrating a given consumption wave S3 when a given image is formed and a supply wave H8 that correct the toner concentration unevenness caused by the consumption wave S3.

In actual image formation, when a given image is formed, the toner concentration sensor 10Y detects, continuously or at intervals, the concentration in the developer from which the toner is consumed. The toner concentration sensor 10Y transmits results of the concentration detection to the prediction calculator 101 of the controller 100. Based on results of the detection, a given consumption wave S4 can be obtained. The consumption wave S4 shows changes in the toner concentration over time at the detection position of the toner concentration sensor 10Y.

The given consumption wave S4 obtained as described above is dissolved into the unit consumption waves S1 shown in FIG. 11 that show changes in the toner concentration over time detected by the toner concentration sensor 10Y when one unit image is developed. When the developer is transported by the first screw 8Y from the detection position corresponding to the unit consumption wave S1 to the detection position B, in the toner concentration changes over time as shown by the unit consumption wave S2 shown in FIG. 11.

Thus, unit consumption waves S2 corresponding to the unit consumption waves S1, respectively, are obtained and synthesized into the given consumption wave S3 that is a wave (prediction) approximate to a wave obtained by measuring changes in the toner concentration in the developer whose toner concentration is uneven as shown by the given consumption wave S4 at the detection position B.

In the present embodiment, by executing a predetermined or given computation program according to the mechanism described above, the prediction calculator 101 calculates a prediction (given consumption wave S3) that represents changes in the toner concentration at the detection position B based on the results (given consumption wave S4) detected by the toner concentration sensor 10Y.

Calculation of the prediction by the prediction calculator 101 (prediction calculator) described above are summarized as follows:

In an experiment, plural basic supply waves whose unit supply amount are different from each other are measured. Next, the unit consumption waves S1 and S2 are measured. The unit consumption waves S1 shows changes in the toner concentration over time when the toner is consumed for the unit image area. The unit consumption wave S2 represents the toner concentration unevenness.

Then, the unit supply wave S6 to correct the toner concentration unevenness indicated by the unit consumption wave S2 is determined by combining the basic supply waves. Further, the unit supply pattern corresponding to this unit supply wave S6 (combination of the basic supply waves) is obtained and stored in the RAM.

Then, in actual image formation, the toner concentration is detected by the toner concentration sensor 10Y and results of the detection is transmitted to the prediction calculator 101. The prediction calculator 101 generates the consumption wave S4 based on the results of the detection and dissolves this consumption wave S4 into unit consumption waves S1 for each unit image area.

The prediction calculator 101 then obtains unit consumption waves S2 corresponding to those consumption waves S1 and combines these consumption wave S2 into the consumption wave S3 that shows predicted changes in the toner concentration at the detection position B.

After the prediction (consumption wave S3) is calculated by the prediction calculator 101 as described above, this prediction is transmitted to the toner supply controller 102. The toner supply controller 102 can generate a unit supply wave H8 that corrects the toner concentration unevenness shown by the given consumption wave S3, that is, a wave from approximate to a phase opposite the given consumption wave S3 by combining the unit supply waves H6 that respectively correspond to the unit consumption waves S2.

More specifically, the toner supply controller 102 determines the combination of the unit supply waves H6 that correspond to the unit consumption waves S2, respectively, based on the prediction, and further determines a toner supply operation by generating a combination of the multiple unit supply patterns stored in RAM that corresponds to the combination of the supply waves H6. Then, the toner supply controller 102 controls the supplier driving source 71Y according to the toner supply operation corresponding to the prediction. Through this toner supply operation, the supply wave H8 that is a synthesis of the unit supply waves H6 according to respective unit supply patterns is obtained.

Therefore, by controlling toner supply as described above, the toner concentration unevenness shown by the given consumption wave S3 is adequately resolved at the detection position B, as shown by a heavy solid line in FIG. 13.

As described above, in the present embodiment, the toner concentration sensor 10Y detects toner concentration at a given detection position located upstream of a predetermined or given toner supply position in the toner circulation direction either continuously or at intervals. Based on results generated by the toner concentration sensor 10Y, the prediction calculator 101 of the controller 100 shown in FIG. 9 calculates (that is, make a prediction of) changes in the toner concentration over time in the developer that is passing the detection position B when toner supply is not performed. The detection position B serving as the prediction position is a given position located in an area starting from the toner supply position, located upstream of the toner feed portion in the developer circulation direction. Then, while the developer is circulated along the developer circulation path, the toner supply controller 102 adjusts the amount of the toner supplied (toner supply amount) through the toner supply position based on the prediction by controlling the supplier driving source 71Y, so as to resolve changes in the toner concentration in the developer that is passing the detection position B.

Therefore, the toner concentration unevenness in the developer is resolved at least at the detection position B and the toner concentration can be equalized before the developer is fed again to the developing roller 12Y at the feed portion after the toner in the developer is consumed in image development.

Further, in the present embodiment, because only a single driving source (supplier driving source 71Y) is used to control the yellow toner supply so as to resolve the toner concentration unevenness, cost is relatively low and the image forming apparatus can be relatively compact.

It is to be noted that, although a single unit consumption wave S2 shown in FIG. 12 is used in the present embodiment, alternatively, a plurality of unit consumption waves S2 that are different from each other can be used to determine unit supply waves H6 corresponding to the unit consumption waves S2, respectively.

A controller 100A according to another embodiment is described below with reference to FIG. 14.

Figure 14:
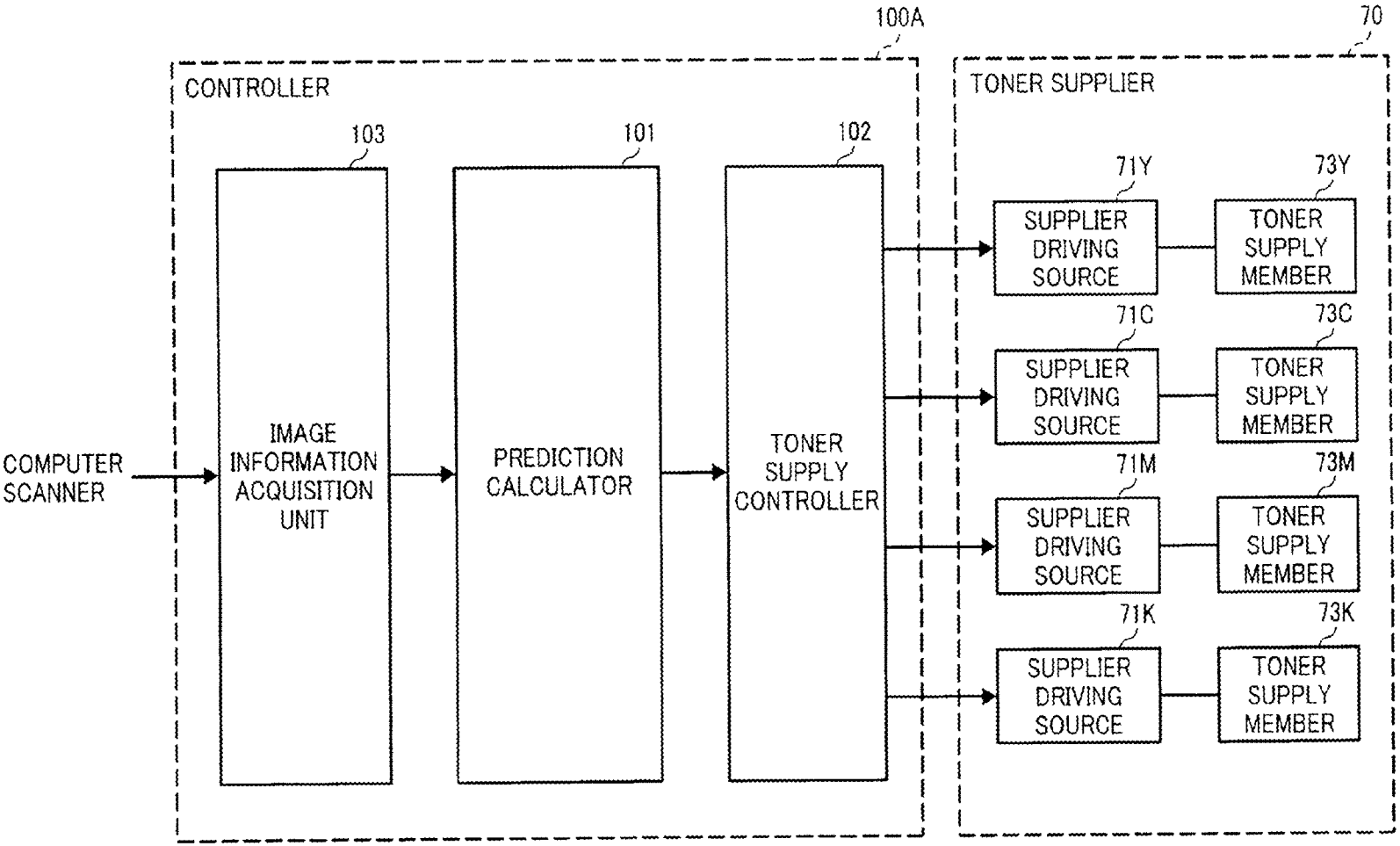
FIG. 14 a functional block diagram of toner supply control according to another illustrative embodiment of the present invention.

As shown in FIG. 14, the controller 100A includes a prediction calculator 101 and a toner supply controller 102, and a toner supplier 70 including toner supply members 73Y, 73C, 73M, and 73K and driving sources 71Y, 71C, 71M, and 71K similarly to the controller 100 shown in FIG. 9. Further, the controller 100A includes an image information acquisition unit 103 that acquires image data (image information) from computers, scanners, etc.

The controller 100A operates in a manner similar to that of the controller 100 shown in FIG. 9 and achieves a similar result except for a method to calculate prediction that is described below, and thus other descriptions are omitted.

The image information acquisition unit 103 transmits necessary data of the image information to the prediction calculator 101 serving as a toner concentration change calculator. Based on the data from the image information acquisition unit 103, the prediction calculator 101 calculates changes in the toner concentration over time at the detection position B that are to be caused when an electrostatic latent image corresponding to the image information is developed.

It is to be noted that, although a prediction is calculated based on image data acquired from computers, scanners, etc., in the present embodiment, alternatively, the number of laser lights (dots) emitted from the optical writing unit 20 shown in FIG. 5 can be used as image information based on which the prediction is calculated. As the optical writing unit 20 shown in FIG. 20 receives an on-off signal for each dot, for example, toner consumption for each image can be predicted by counting and adding together these signals. This signal can be counted for each area of the image, and a consumption wave for each area can be predicted.

The toner supply controller 102 controls the supplier driving source 71Y of the toner supplier 70 based on the prediction calculated by the prediction calculator 101. The prediction calculator 101 calculates the prediction regarding changes in the toner concentration in the developer in the detection position B based on the image data by using computation programs, computation tables such as LUTs, etc., stored in the ROM. Then, the toner supply controller 102 determines a combination of multiple unit supply patterns based on the prediction and controls the supplier driving source 71Y according to that combination so as to resolve the toner concentration unevenness.

The unit supply patterns are preliminarily obtained through experiment. One example of a procedure to create the unit supply patterns is described below.

Firstly, an experimental toner concentration sensor is provided in the developing unit 7Y to detect a toner concentration in the developer that is passing the detection position B shown in FIG. 8. Similarly to the embodiment described with reference to FIG. 9, the multiple basic supply waves caused by the multiple basic supply operations of the toner supplier 70 are measured as shown in FIG. 10.

Subsequently to the measurement of the basic supply patterns, reference consumption waves are measured for each area of the surface of the photoreceptor drum 3Y divided in a photoreceptor axial direction that is a direction perpendicular to a direction in which the surface of the photoreceptor drum 3Y moves. On each area thus divided, an identical electrostatic latent image having a minimum unit area for toner concentration detection is formed and developed as a unit image with the yellow developer in which the toner concentration is uniform. After each electrostatic latent image is developed and no toner is supplied, changes in the toner concentration thereof are detected as the reference consumption wave at the detection position B with the experimental toner concentration sensor, which is described below with reference to FIG. 15.

It is to be noted that the minimum unit area of the unit image is preferably a smallest settable unit area, which depends on resolution capability of the sensor, effects of noise, and minimum amount of the toner supplied by the supplier 70, although an ideal unit area is one dot area of image information as described above. Further, division intervals of the surface of the photoreceptor drum 3Y are set according to the unit area of the unit image.

Figure 15:
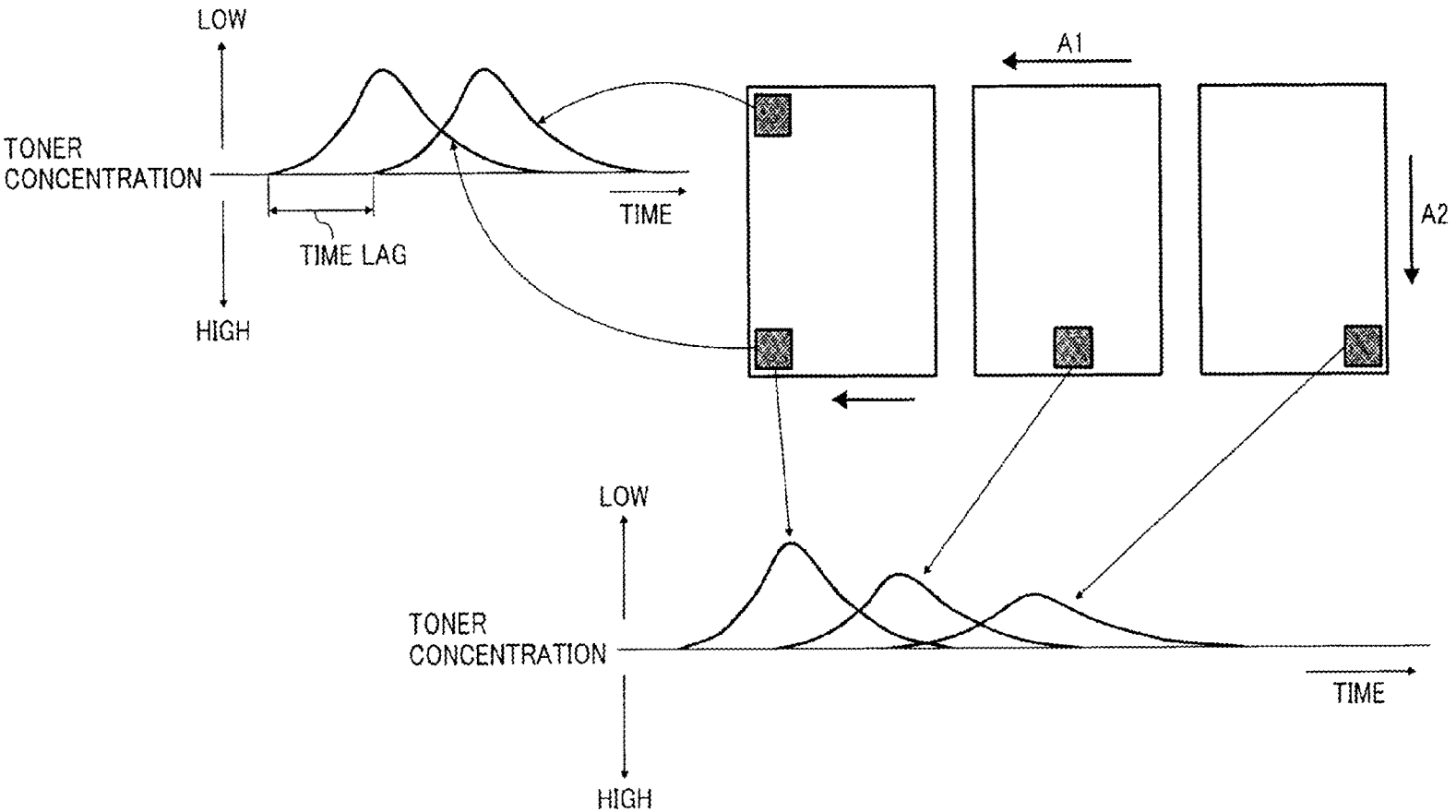
FIG. 15 illustrates relations between locations of latent images formed on the photoreceptor drum and toner concentration unevenness.

Through the measurement described above, a graph illustrated in a lower portion of FIG. 15 is obtained. It is to be noted that only cases in which electrostatic latent images are formed in a right end portion, a left end portion, and a center portion in the axis photoreceptor direction are shown in FIG. 15.

As shown in the graph shown in the lower portion of FIG. 15, when the reference consumption waves recording these three latent images formed on different areas of the photoreceptor drum 3Y are compared with each other, their half bandwidths and minimum toner concentrations are different from each other because a distance between the position where the developer returns to the developer circulation path after passing the development area and the toner concentration detection position B shown in FIG. 8 is different in each of these cases. Accordingly, the developer is agitated to different degrees in these cases before the developer is transported to the detection position B after returning to the developer circulation path. Further, peaks of these reference consumption waves are different from each other because the portion of the developer from which the toner is consumed reaches the detection position B at different times.

Further still, a graph shown in a left portion of FIG. 15 shows reference consumption waves after latent images formed on different portions of the photoreceptor drum 3Y in the direction of surface movement are developed. When these reference consumption waves are compared with each other, they have identical or similar half bandwidth and minimum toner concentration, only their peaks are different from each other.

Therefore, when the reference consumption waves regarding different positions in the photoreceptor axial direction are obtained, a reference consumption wave regarding a position different in the moving direction of the surface of the photoreceptor drum 3Y can be determined by shifting a phase of the reference consumption wave regarding the position identical to that position in the photoreceptor axial direction. Therefore, by measuring the reference consumption waves regarding respective areas divided only in the photoreceptor axial direction, reference consumption waves of the unit latent images formed other areas of the photoreceptor 3Y can be calculated.

After the reference consumption wave for each divided area of the photoreceptor drum 3Y is thus determined, a unit supply wave that compensates for the toner concentration unevenness shown by the reference consumption wave is determined for each area of the photoreceptor drum 3Y.

Figure 16:
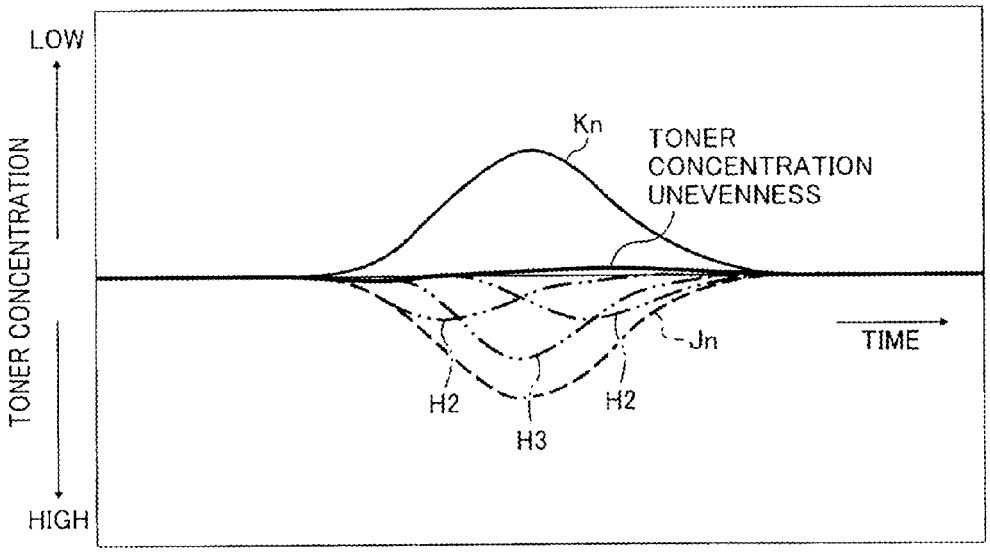
FIG. 16 is graph showing a given reference consumption wave and a unit supply wave that corrects toner concentration unevenness shown by the given reference consumption wave.

FIG. 16 is a graph showing a given reference consumption wave Kn and a unit supply wave Jn that compensate for the toner concentration unevenness shown by the reference consumption wave Kn.

The unit supply wave Jn is determined by combining the basic supply waves H1, H2, H3, H4, and H5 shown in the graph shown in FIG. 10 so as to compensate for the reference consumption wave Kn. Therefore, the toner concentration unevenness caused when a latent image corresponding to the reference consumption wave Kn is developed can be resolved at least downstream of the detection position B by supplying the toner so as to produce this unit supply wave Jn. A toner supply operation corresponding to each combination of the basic supply waves H1, H2, H3, H4, and H5 is a unit supply pattern and stored in the RAM.

Toner supply control in actual image formation according to the present embodiment is described below.

Figure 17:
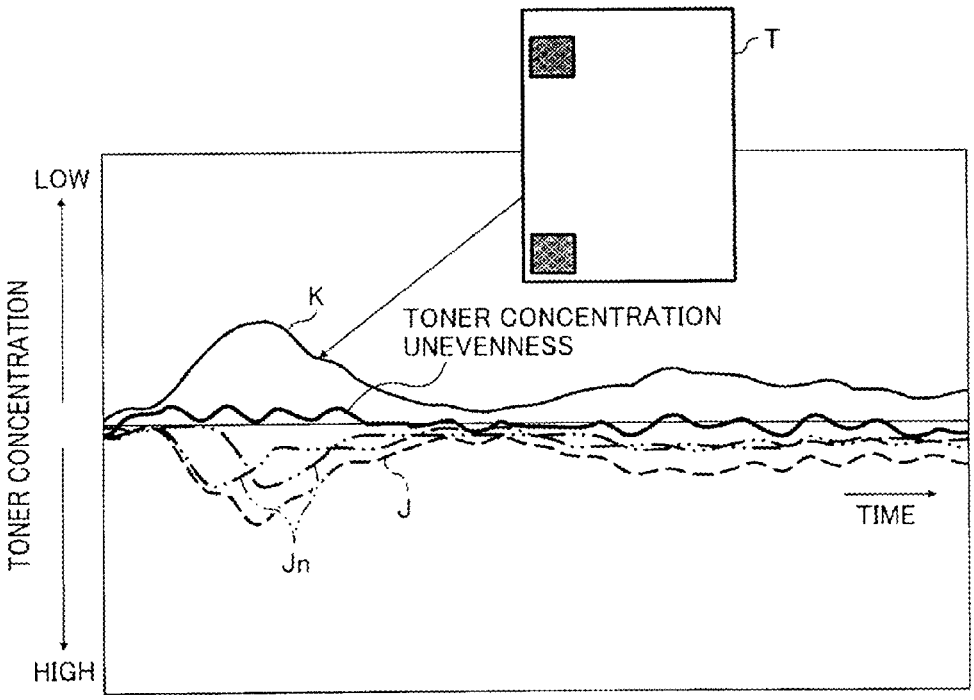
FIG. 17 illustrates a given image, a consumption wave corresponding to the given image, and a supply wave that corrects toner concentration unevenness shown by the consumption wave.

FIG. 17 shows a given image T, a given consumption wave K showing toner concentration unevenness caused after the image T is developed, and a supply wave J to compensate for the toner concentration unevenness shown by the given consumption wave K.

When a given image is formed in actual image formation, image data thereof is transmitted to the prediction calculator 101 of the controller 100A shown in FIG. 14. The prediction calculator 101 dissolves a latent image based on the image data into portions corresponding to respective areas of the photoreceptor drum 3Y.

For example, the prediction calculator 101 measures distribution of portions where the yellow toner is adhered (toner distribution) for each portion of the dissolved latent image portion and then calculate a rate of toner distribution to that of the unit image used to measure the reference consumption wave Kn for each portion. Based on this toner distribution rate, the reference consumption waves Kn are multiplied or reduced according to this comparison so as to calculate the consumption waves regarding those dissolved portion of the latent image, respectively.

These consumption waves for respective portions are then combined into a wave (prediction) approximate to the given consumption wave K shown in FIG. 17, that is, a consumption wave showing changes in the toner concentration over time in the developer that is passing the detection position B after development of the latent image corresponding to that image data.

In the present embodiment, the prediction calculator 101 calculates the given consumption wave K corresponding to the image data as a prediction by synthesizing the plural reference consumption waves Kn by executing a predetermined or given computation program according to the mechanism described above.

The prediction (synthesized wave from plural unit consumption waves Kn) calculated by the prediction calculator 101 is transmitted to the toner supply controller 102. By synthesizing plural unit supply waves Jn that respectively correspond to the unit consumption waves Kn that are components of the prediction, the supply wave J that corrects the toner concentration unevenness shown by the given consumption wave K can be generated.

The toner supply controller 102 synthesizes the unit supply waves Jn according to the synthesized wave of the unit consumption waves Kn based on the prediction. Then, the toner supply controller 102 combines various basic supply patterns stored in the RAM so as to correspond the synthesized wave of the unit supply waves Jn, and thus a toner supply operation corresponding to the prediction is determined. Then, the toner supply controller 102 controls the supplier driving source 71Y according to this toner supply operation. This toner supply operation produces a supply wave generated by synthesizing the unit supply patterns Jn, that is, the supply wave J shown in FIG. 17. Therefore, the toner concentration unevenness shown by the given consumption wave K is adequately resolved at the detection position B as shown by a heavy solid line in FIG. 17.

It is to be noted that, although the latent images having an identical image area are used to measure respective unit consumption waves Kn in the present embodiment, alternatively, latent images having different image areas may be used to measure respective unit consumption waves Kn.

As described above, in the controller 100A shown in FIG. 14 according to the present embodiment, the image information acquisition unit 103 acquires image data. Then, the prediction calculator 101 calculates, based on the image data, changes in the toner concentration over time (prediction) when toner supply is not performed at the detection position B, and the toner supply controller 102 adjusts the amount of the toner supplied through the toner supply position based on the prediction by controlling the supplier driving source 71Y so as to resolve changes in the toner concentration in the developer that is passing the detection position B, similarly to those of the controller 100 shown in FIG. 9.

A variation of the embodiment described above is described below with reference to FIGS. 18 through 22. This employs a method that achieves effects similar to the method in which the prediction calculator 101 calculates a toner supply pattern by dissolving the synthesized consumption wave (prediction) into reference consumption waves and synthesizing the unit supply waves corresponding to those reference consumption waves. In this variation, the amount of the toner supplied is directly calculated according to image information for each control sampling cycle by using a reverse phase filter that indicates a toner supply pattern to induce a supply wave form having a phase opposite that of the consumption wave.

Toner supply control according to the present variation is performed by the controller 100A shown in FIG. 14 and has a functional block identical to that shown in FIG. 14. The image information acquisition unit 103 acquires image data (image information) from computers, scanners, etc., and signals according to the image data is given to the reverse phase filter. The reverse phase filter generates, according to the signals, a wave form having a phase opposite that of the consumption wave as a prediction, and a toner supply pattern that induces the wave form having a phase opposite that of the consumption wave is determined. The amount of the toner supplied in each control sampling cycle is calculated according to this supply pattern based on the image information.

It is to be noted that, although the amount of the toner supplied is calculated based on image data acquired from computers, scanners, etc., also in the present variation, alternatively, the number of laser lights (dots) emitted from the optical writing unit 20 shown in FIG. 5 can be used as image information based on which the amount of the toner supplied is calculated.

The reverse phase filter can be preliminarily created through experiment. An example of a procedure to create the reverse phase filter is described below with reference to FIG. 18, in which a part of the photoreceptor drum 3Y and a graph showing a consumption wave SA and a unit supply wave H9 are illustrated.

Referring to FIG. 8, an experimental toner concentration sensor is provided in the developing unit 7Y to detect a toner concentration in the developer that is passing the detection position B (prediction position) provided in an area located upstream of the developer feed position, starting from the toner supply position facing the toner supply port 17Y in the developer circulation direction. Then, the toner is supplied through the toner supply port 17, and changes in the toner concentration in the developer over time are measured with the experimental toner concentration sensor. Based on this measurement, the unit supply wave H9 shown in the graph shown in FIG. 18 that is a characteristic of an actual image forming apparatus is obtained.

It is to be noted that only a single supply wave corresponding to a typical toner supply amount is measured as a unit supply wave in the present embodiment.

Figure 18:
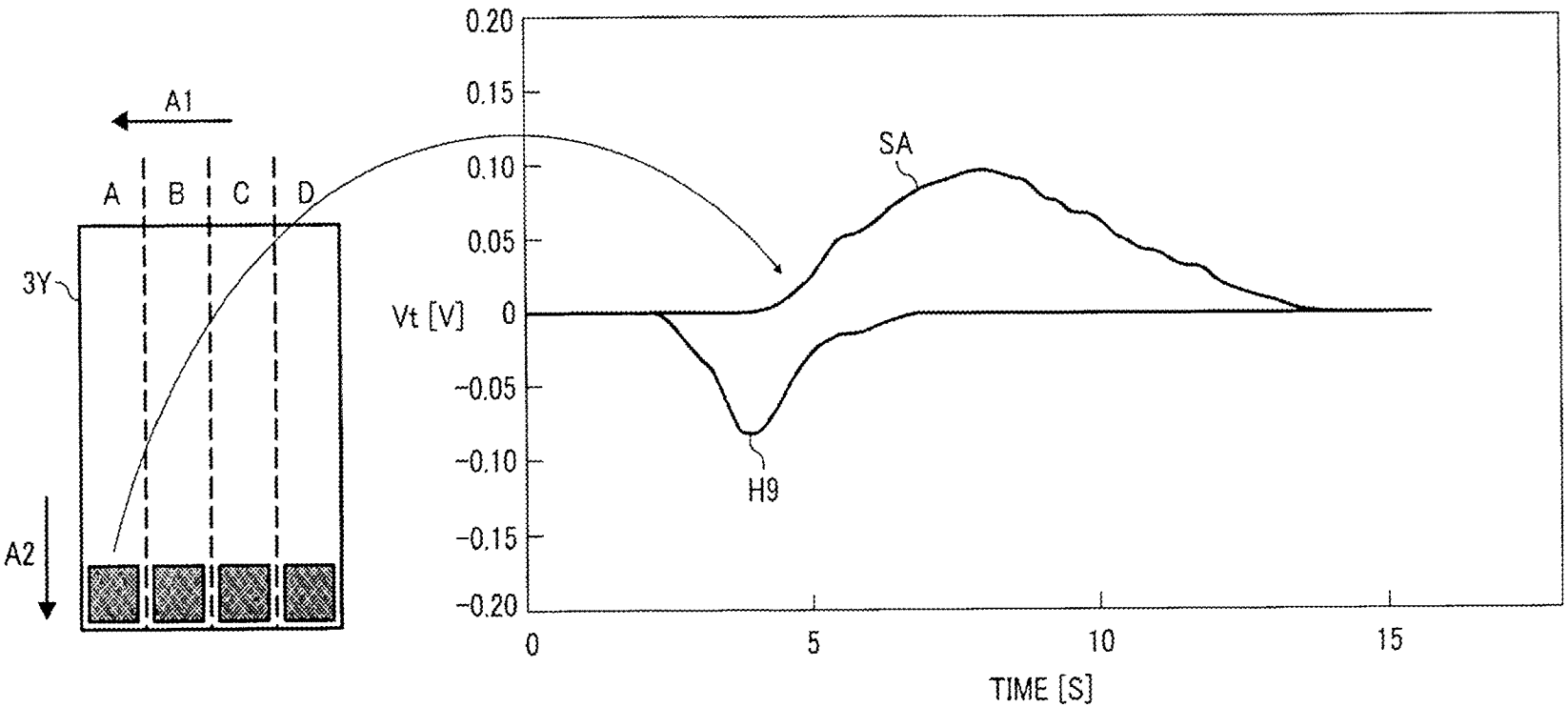
FIG. 18 a illustrates areas of the photoreceptor drum divided in a main scanning direction, and a graph showing a unit supply wave and a reference consumption wave corresponding to one of the divided area.

As shown in a left portion of FIG. 18, the surface of the photoreceptor drum 3Y is divided into plural areas A, B, C, and D in the photoreceptor axis direction (main scanning direction) shown by arrow A1 that is perpendicular to the direction shown by arrow A2 (sub-scanning direction) in which the surface of the photoreceptor drum 3Y moves. In each of the divided areas A, B, C, and D, a latent image of an identical unit image having a minimum unit area for toner concentration detection is formed, and this latent image is developed with the developer in which toner concentration is uniform.

After each latent image is developed, changes in the toner concentration in the developer over time are measured at the detection position B with the experimental toner concentration sensor without supplying the toner, and thus the reference consumption wave is obtained for each of the areas A, B, C, and D. These reference consumption waves SA are characteristics of an actual image forming apparatus. Although only the consumption wave SA regarding the area A of the photoreceptor drum 3Y is shown in the graph shown in FIG. 18, the reference consumption wave is measured for each area of the photoreceptor drum 3Y.

It is to be noted that the minimum unit area used to measure the reference consumption wave is preferably a smallest settable unit area, which depends on resolution capability of the sensor, effects of noise, and minimum amount of the toner supplied by the supplier 70, although an ideal unit area is one dot area of image information. For example, when the sensor has a relatively low resolution capability or the controller has a limited processing speed, the minimum unit area may be set to an entire area of a recording sheet, with amplitude of the consumption wave approximating a total image area for each printed sheet.

Further, division intervals of the surface of the photoreceptor drum 3Y are set according to the minimum unit area of the unit image.

Figure 19:
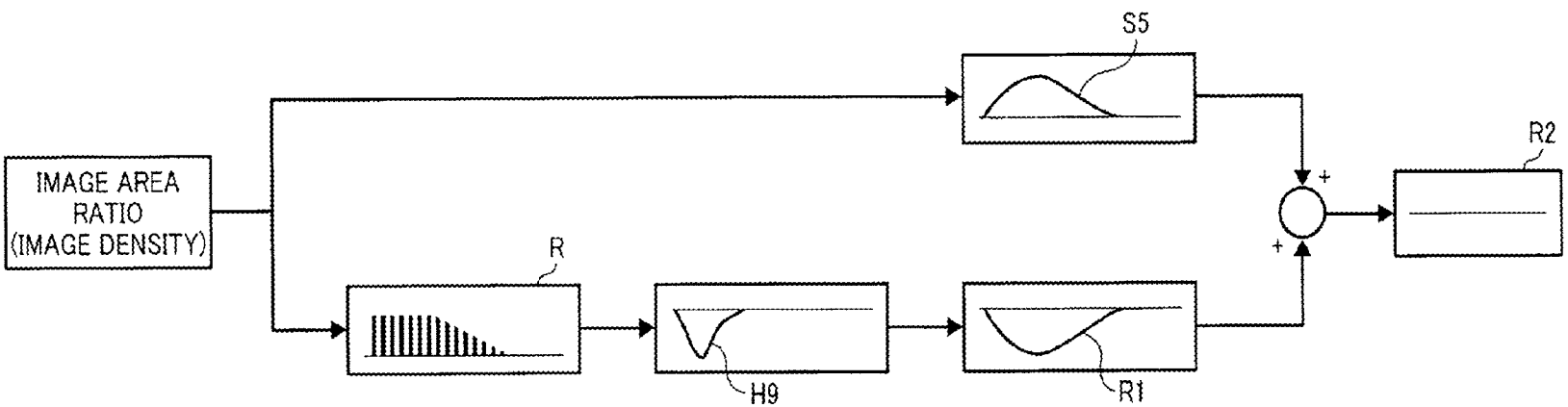
FIG. 19 illustrates relations among a reverse phase filter, a consumption wave, the unit supply wave, and a reverse phase wave.

Based on the unit supply wave H9 and the reference consumption waves obtained as described above, a reverse phase filter that satisfies relations shown in FIG. 19 is created for each minimum unit area. In FIG. 19, a reference character R indicates a graph of a reverse phase filter. In the reverse phase filter graph R, a vertical axis shows a supply amount indicated for each control sampling cycle, such as toner amount in milligrams and a value converted from motor driving time in milliseconds, and a horizontal axis shows the control sampling cycle. One sample cycle is an interval between bars in the reverse phase filter graph R and is typically a fixed value, for example, 200 milliseconds.

Figure 20:
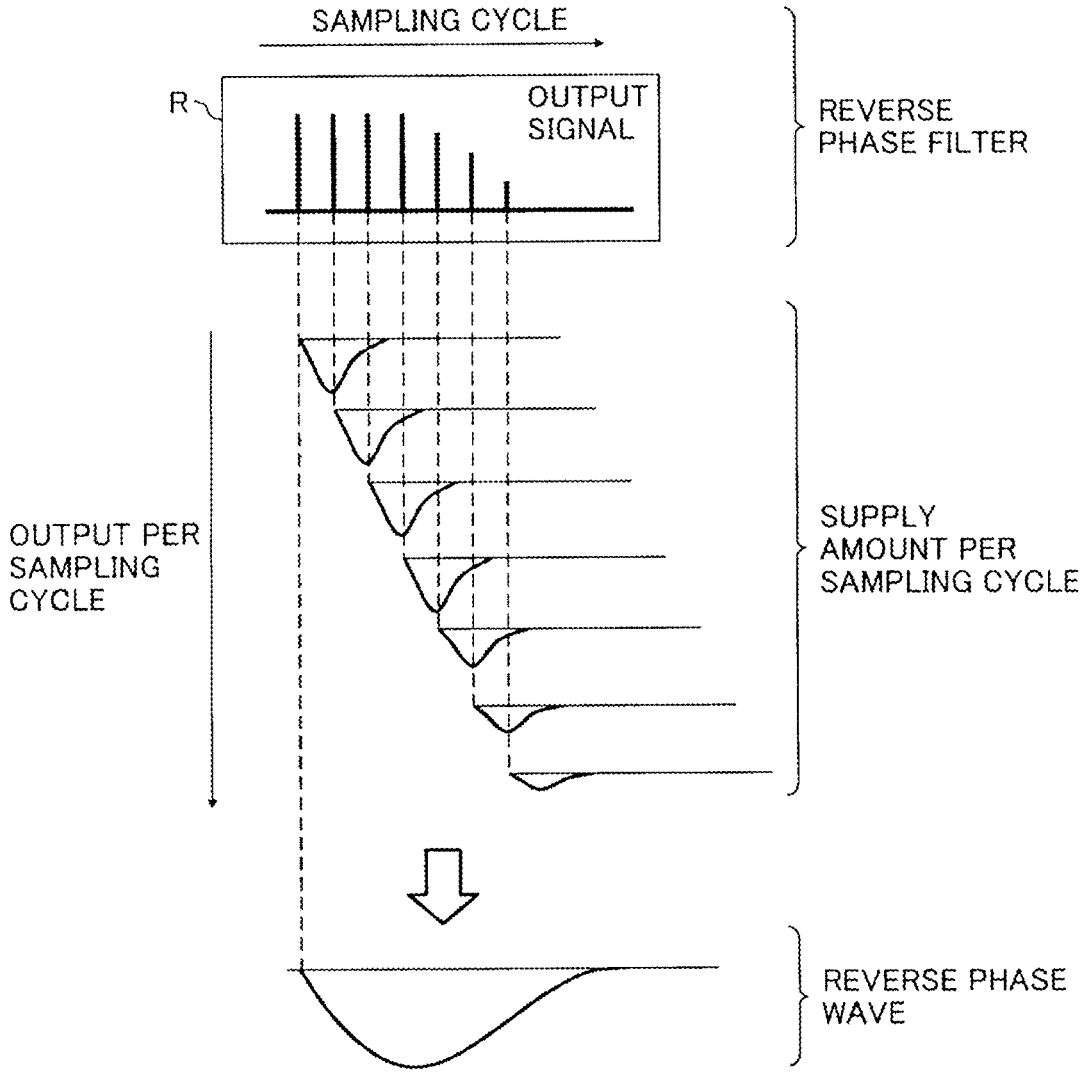
FIG. 20 illustrates relations among the reverse phase filter, the unit supply wave, and the reverse phase wave.

The relations shown in FIG. 19 are described below using FIG. 20.

When an amount of the toner corresponding to a given image area ratio is consumed, a dummy impulse based on that image area ratio is given to the reverse phase filter R. Reference character S5 indicates the change in the toner concentration caused by this toner consumption.

The reverse phase filter generates an impulse response according to the dummy impulse for each control sample cycle. In FIG. 20, a reverse phase wave form R1 indicating the amount of the toner supplied is generated based on amplitudes of the impulse responses of the respective sampling cycles. The toner concentration unevenness indicated by the consumption wave S5 is corrected by supplying the amount of the toner indicated by the reverse phase wave form R1 because the reverse phase wave form R1 has a phase opposite that of the consumption wave S5. In FIG. 19, reference characters R2 indicates a graph showing changes in the toner concentration in the developer over time after the supply operation (supply result). As shown in the graph R2, the toner concentration is thus equalized after the supply operation.

Although the reverse phase filter is generated through a commonly known system identification method, which is Filtered-X LMS method in the present embodiment, the reverse phase filter generation method is not limited thereto. Alternatively, the reverse phase filter can be generated by using a FIR (finite impulse response) filter installed on a DSP (digital signal processor), a parametric model using an IIR (infinite impulse response) filter.

It is to be noted that a delay factor may be provided before and/or after the reverse phase filter R when there is a time lag between the consumption waves and the unit supply wave H9.

Figure 21:
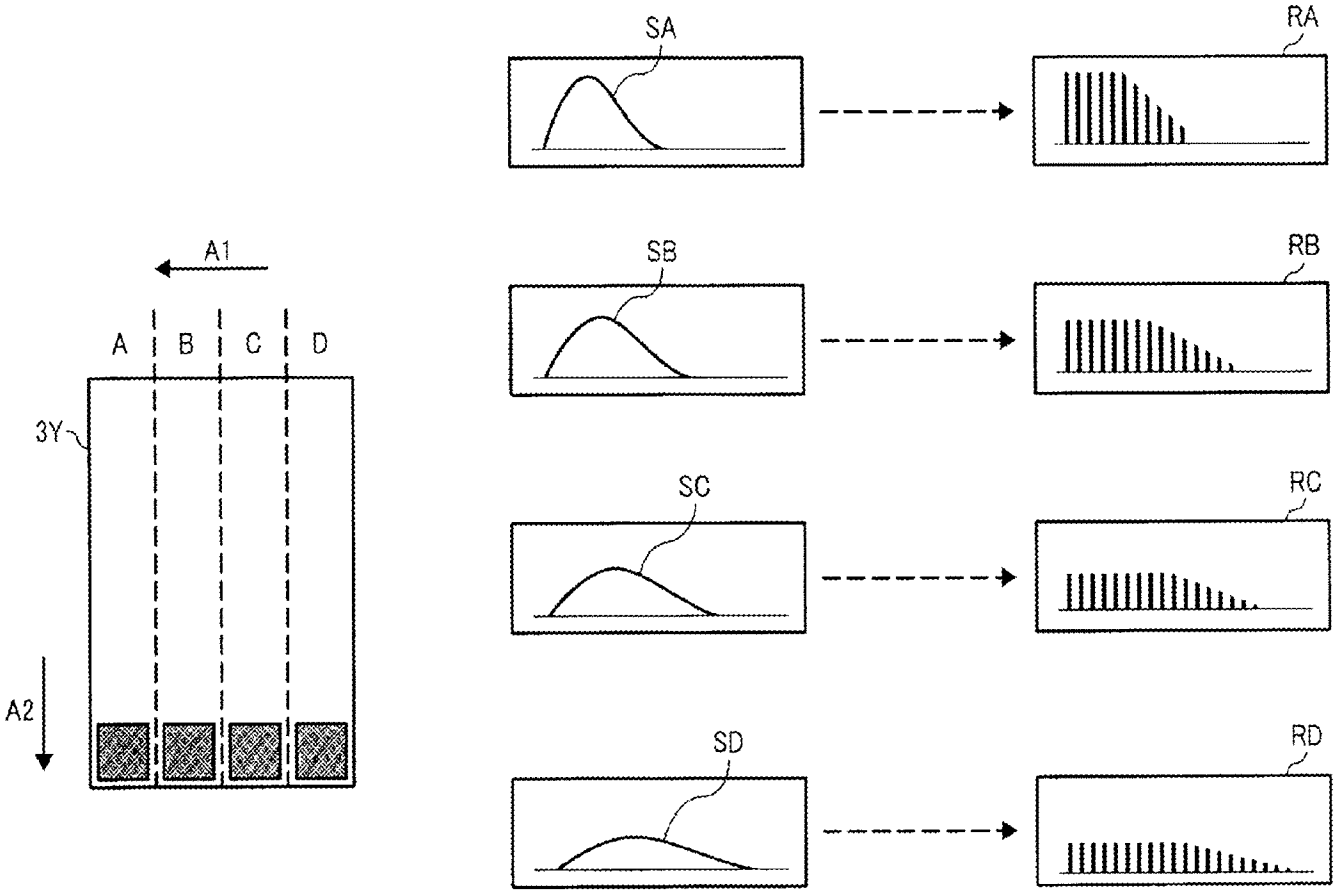
FIG. 21 illustrates reverse phase filters for the consumption waves corresponding to the divided areas of the photoreceptor drum, respectively.

FIG. 21 illustrates reverse phase filters RA, RB, RC, and RD generated through the method described above.

FIG. 21, reference consumption waves SA, SB, SC, and SD are consumption waves regarding the minimum unit image area formed in the areas A, B, C, D of the photoreceptor 3Y divided in the main scanning direction shown by arrow A1, respectively. The reverse phase filters RA, RB, RC, and RD respectively correspond to these consumption waves SA, SB, SC, and SD.

When the position and/or the area of an actual image change from those of the unit image, the amount of the toner supplied can be determined by superimposing output results of the reverse phase filters corresponding to the minimum unit areas, and thus a given reverse phase wave form can be generated. That is, the reverse phase filter automatically outputs impulse responses each having an amplitude in proportion to that of the dummy impulse signal after a given dummy impulse signal is input to the reverse phase filter at a given time.

It is to be noted that a single reverse phase filter is generated for each area of the photoreceptor drum 3Y divided in the main scanning direction. When separate dummy impulse signals are sequentially input to the reverse phase filter, the reverse phase filter automatically generates the reverse phase wave form based on those dummy impulse signals by generating impulse responses in proportion to the dummy impulse signals and shifting the impulse responses according to the time lag.

Further, when an actual image area ratio is smaller than the minimum unit area, an amplitude of a dummy impulse signal transmitted to the reverse phase filter is multiplied to an amplitude corresponding to the minimum unit area, and thus output value from the reverse phase filter is automatically changed to a value corresponding to the minimum unit area.

Figure 22:
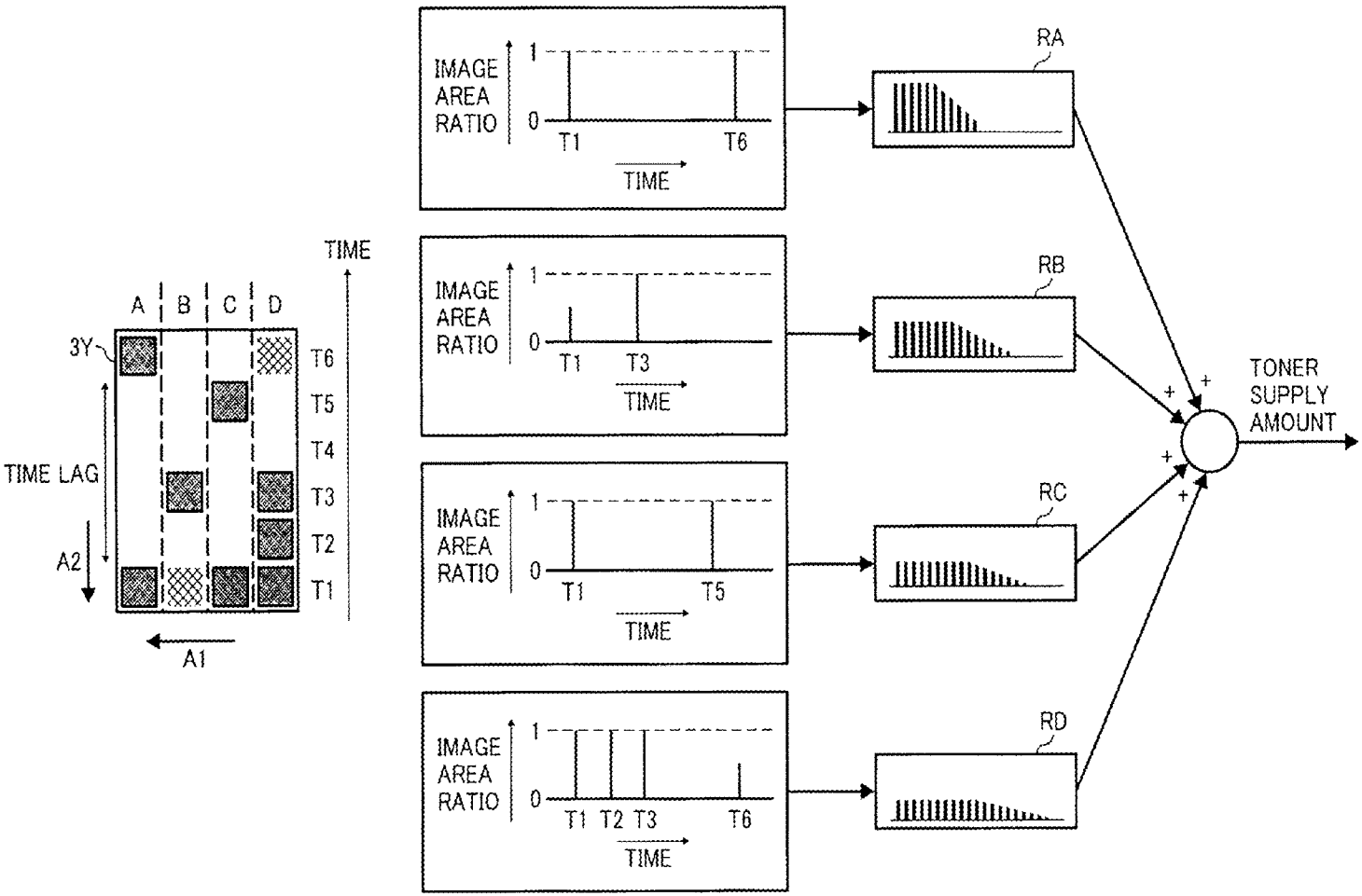
FIG. 22 illustrates calculation of the reverse phase wave according to image information by using the reverse phase filter.

FIG. 22 illustrates relations between location of a latent image on the photoreceptor drum 3Y and toner concentration unevenness. In the present variation, the prediction calculator 101 calculates, as a prediction, a reverse phase wave form of a consumption wave corresponding to image information by using the reverse phase filter. Calculation of the reverse phase wave form (prediction) of the consumption wave corresponding to image information shown in a left portion of FIG. 22, and toner supply operation based on the prediction are described below with reference to FIGS. 8, 14, and 22.

When the user forms an image according to the image information shown in the left portion of FIG. 22, the image information acquisition unit 103 shown in FIG. 14 calculates an image area ratio in the minimum unit area for each of the areas A, B, C, and D of the photoreceptor drum 3Y and transmits the image area ratios to the prediction calculator 101.

The prediction calculator 101 generates dummy impulse signals having amplitudes according to the image area ratios, respectively, in view of a time lag of the image formation, and transmits these dummy impulse signals to reverse phase filters respectively corresponding to the areas A, B, C, and D divided in the main scanning direction shown by arrow A1.

The reverse phase filters respectively generates impulse responses for each control sampling cycle according to the dummy impulse signals, and generates supply patterns indicating the amount of the toner according to amplitudes of the impulse signals. The supply wave form induced by this supply pattern has a phase opposite the phase of a consumption wave determined for each area divided in the main scanning direction shown by arrow A1.

The amount of the toner supplied, calculated for respective areas divided in the main scanning direction, is added together for each control sampling cycle, and thus an amount of the toner supplied is calculated so as to induce a wave form showing a phase opposite that of predicted changes in the toner concentration over time in the developer that is passing the detection position B shown in FIG. 8 when the toner is not supplied.

Then, the toner supply controller 102 controls the toner supplier 70 to supply the amount of the toner thus calculated for each control sampling cycle.

Because the prediction is generated by superimposing the reverse phase wave forms regarding the consumption waves for respective areas divided in the main scanning direction, respectively, the consumption wave caused by image formation according to the image information shown in FIG. 22 is compensated when the toner supplier 70 supplies the toner according to the amount thus calculated. Thus, the toner concentration at the detection position B shown in FIG. 8 can be equalized.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus configured to form an image on a recording medium, comprising:

a latent image carrier;

an image information acquisition unit configured to acquire image information;

a latent image forming unit configured to form an electrostatic latent image on the latent image carrier according to the image information;

a memory unit to store at least one of a unit toner consumption information in each of multiple divided areas of the image and a reference toner supply pattern corresponding to the unit toner consumption information;

a developing unit configured to develop the latent image with a two-component developer, the developing unit including:

a developer transport member configured to circulate the two-component developer along a developer circulation path, and a developer carrier configured to transport the two-component developer between a development area facing the latent image carrier and the developer circulation path;

a toner supplier including a driving source and a toner supply member, connected to the developer circulation path and configured to supply toner at a predetermined supply position to the two-component developer circulating through the developer circulation path by driving the toner supply member with the driving source;

a prediction calculator configured to divide the image information acquired by the image information acquisition unit in accordance with the multiple divided areas and to predict a supply pattern to reduce changes in toner concentration over time in the developer at a given prediction position based on the divided image information and at least one of the unit toner consumption information for each of the multiple divided areas and the reference toner supply pattern stored in the memory unit; and a toner supply controller configured to control the driving source according to the predicted supply pattern to adjust an amount of the toner supplied to the two-component developer at the predetermined supply position.

2. The image forming apparatus according to claim 1, wherein the unit toner consumption information comprises a consumption waveform that is a waveform output from an experimental toner concentration detector when a unit latent image in each of the multiple divided areas is developed, the experimental toner concentration detector disposed at the predetermined supply position or downstream of the predetermined supply position and upstream of a developer feed position where the two-component developer is fed to the developer carrier in a developer circulation direction, and the toner supply information comprises a waveform with a phase opposite a phase of the consumption waveform.

3. The image forming apparatus according to claim 1, wherein the multiple divided areas are obtained by dividing the surface of the latent image carrier at least in the main scanning direction, and the unit toner consumption information regarding an identical image differs depending on the position in the main scanning direction.

4. A toner supply control method used in an image forming apparatus, the method comprising:

storing, in a memory unit, at least one of unit toner consumption information for each of multiple divided areas of an image and a reference toner supply pattern corresponding to the unit toner consumption information;

forming an electrostatic latent image on the latent image carrier according to image information;

developing the latent image with a two-component developer;

supplying, with a toner supplier, toner at a predetermined supply position to the two-component developer circulating through a developer circulation path;

dividing the image information in accordance with the multiple divided areas;

predicting a toner supply pattern to reduce changes in toner concentration over time in the developer at a given prediction position based on the divided image information and at least one of the unit toner consumption information for each of the multiple divided areas and the reference toner supply pattern stored in the memory unit; and driving a driving source of the toner supplier according to the predicted toner supply pattern to adjust an amount of the toner supplied to the two-component developer at the predetermined supply position.

* * * * *